US008279152B2

(12) United States Patent
Murai

(10) Patent No.: US 8,279,152 B2
(45) Date of Patent: Oct. 2, 2012

(54) ELECTRO-OPTICAL DEVICE AND CIRCUIT FOR DRIVING ELECTRO-OPTICAL DEVICE TO REPRESENT GRAY SCALE LEVELS

(75) Inventor: Kiyoaki Murai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1257 days.

(21) Appl. No.: 11/354,924

(22) Filed: Feb. 16, 2006

(65) Prior Publication Data

US 2006/0214897 A1 Sep. 28, 2006

(30) Foreign Application Priority Data

Mar. 23, 2005 (JP) ..... 2005-083382
Sep. 21, 2005 (JP) ..... 2005-273405

(51) Int. Cl.
*G09G 3/36* (2006.01)

(52) U.S. Cl. ..... 345/94; 345/89

(58) Field of Classification Search ..... 345/89, 345/94, 95, 98, 99, 691
See application file for complete search history.

(56) References Cited

U.S. PATENT DOCUMENTS 6,753,854 B1 * 6/2004 Koyama et al. ..... 345/690
6,788,280 B2 * 9/2004 Ham ..... 345/89
6,977,636 B2 12/2005 Jinda et al.
7,209,103 B2 * 4/2007 Maeda et al. ..... 345/87
7,468,716 B2 * 12/2008 Lee et al. ..... 345/89
7,522,140 B2 4/2009 Jinda et al.
2003/0006952 A1 * 1/2003 Hong ..... 345/89
2005/0001802 A1 * 1/2005 Lee ..... 345/89
2005/0162360 A1 * 7/2005 Ishihara et al. ..... 345/89

FOREIGN PATENT DOCUMENTS

JP A 02-127618 5/1990
JP A 2000-338916 12/2000
JP A 2001-236046 8/2001
JP A 2002-116743 4/2002
JP A 2004-264725 9/2004

* cited by examiner

*Primary Examiner* — Chanh Nguyen
*Assistant Examiner* — Allison Walthall
(74) *Attorney, Agent, or Firm* — Oliff & Berridge, PLC

(57) ABSTRACT

An electro-optical device drives a plurality of pixels to represent gray scale levels based on effective voltages by dividing one frame into a plurality of fields, and includes a calculating unit that receives image data specifying gray scale values in each frame for each pixel. A voltage pattern determining unit that determines to supply a first effective voltage shifted in a variation direction, rather than a voltage according to a gray scale value specified in the image data of a later frame of the adjacent frames, in a previous field of the plurality of fields in the later frame, while determining to supply a second effective voltage shifted in a direction opposite the variation direction, rather than the voltage according to the gray scale value specified in the image data of the later frame, in a later field of the plurality of fields in the later frame, for the pixel.

1 Claim, 24 Drawing Sheets

ELECTRO-OPTICAL DEVICE AND CIRCUIT FOR DRIVING ELECTRO-OPTICAL DEVICE TO REPRESENT GRAY SCALE LEVELS

BACKGROUND

1. Technical Field

The present invention relates to a technique for improving display responsiveness in an electro-optical device.

2. Related Art

For an electro-optical device such as a liquid crystal display panel, there has been suggested a technique of suppressing display flickers while representing halftones using a pseudo value by periodically outputting different driving voltages for each frame, for example, in order to increase gray scale levels over the value of driving voltages (referred to as JP-A-2-127618).

However, in the above-mentioned technique, in some cases, a response speed of the liquid crystal display panel may be delayed depending on gray scale levels to be represented. For example, when gray scale levels, which are greatly different from gray scale levels of previous frames, are represented, in some cases, there is a phenomenon in that previously displayed images seem to remain behind. The a phenomenon is generated due to a low response speed of liquid crystal material in the liquid crystal display panel.

SUMMARY

An advantage of some aspects of the invention is that it provides an electro-optical device, a circuit for driving the electro-optical device, and a method of driving the electro-optical device, which is capable of improving display responsiveness while increasing representable gray scale levels when electro-optical material having slow optical responsiveness, such as liquid crystal, is used to display images.

An electro-optical device according to an aspect of the invention drives a plurality of pixels to represent gray scale levels based on effective voltages by dividing one frame into a plurality of fields, and includes a calculating unit that receives image data specifying gray scale values in each frame for each pixel and obtains the amount of variation of a voltage to be applied to the pixel over adjacent frames, a discriminating unit that discriminates whether or not the amount of variation of the voltage satisfies a predetermined condition; a voltage pattern determining unit that determines to supply a first effective voltage shifted in a variation direction, rather than a voltage according to a gray scale value specified in the image data of a later frame of the adjacent frames, in a previous field of the plurality of fields in the later frame, while determining to supply a second effective voltage shifted in a direction opposite to the variation direction, rather than the voltage according to the gray scale value specified in the image data of the later frame, in a later field of the plurality of fields in the later frame, for the pixel, when it is discriminated in the discriminating unit that the predetermined condition is satisfied, and a driving circuit that supplies the first and second effective voltages determined in the voltage pattern determining unit in each field of the later frame for each pixel. According to the invention, it is possible to increase a display response speed.

Preferably, the voltage pattern determining unit determines the first and second effective voltages such that the gray scale value specified in the image data of the later frame of the adjacent frames in a time manner becomes an average of a first gray scale value corresponding to the first effective voltage and a second gray scale value corresponding to the second effective voltage. With this configuration, it is possible to increase representable gray scale levels.

Preferably, the predetermined condition in the discriminating unit is, first, that the amount of variation of the voltage is not 0, second, that the amount of variation of the voltage exceeds a predetermined threshold, and third, when the voltage supplied to the pixel is specified by a positive polarity and a negative polarity with a predetermined potential as a reference, that the polarity is reversed over the adjacent frames.

Preferably, the voltage pattern determining unit includes a voltage pattern storing unit that stores voltage patterns including the first and second effective voltages in advance, and a voltage pattern selecting unit that selects a voltage pattern corresponding to the amount of variation of the voltage and the gray scale value specified in the image data from the voltage patterns stored in the voltage pattern storing unit. The first and second effective voltages are determined based on the selected voltage pattern.

Preferably, the first and second effective voltages are voltage signals according to the first and second gray scale values, which are symmetrical with respect to the gray scale value specified in the image data, or pulse signals each having a pulse width according to the gray scale values, which are symmetrical with respect to the gray scale value specified in the image data.

To achieve the above advantage, the present invention also provides an electro-optical device for driving a plurality of pixels to represent gray scale levels based on effective voltages, with one frame divided into a plurality of fields, including a calculating unit that receives image data specifying gray scale values in each frame for each pixel and obtains the amount of variation of a voltage to be applied to the pixel over adjacent frames; a discriminating unit that discriminates whether or not the amount of variation of the voltage satisfies a predetermined condition; a voltage pattern determining unit that determines to supply a first effective voltage shifted in a direction opposite to a variation direction, rather than a voltage according to a gray scale value specified in the image data of a previous frame of the adjacent frames, in a previous field of the plurality of fields in the previous frame, while determining to supply a second effective voltage shifted in the variation direction, rather than the voltage according to the gray scale value specified in the image data of the previous frame, in a later field of the plurality of fields in the previous frame, for the pixel, when it is discriminated in the discriminating unit that the predetermined condition is satisfied, and a driving circuit that supplies the first and second effective voltages determined in the voltage pattern determining unit in each field of the previous frame for each pixel.

Further, in addition to the electro-optical device, the present invention provides a circuit for driving the electro-optical device and a method of driving the electro-optical device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings.

First Embodiment

Figure 1:
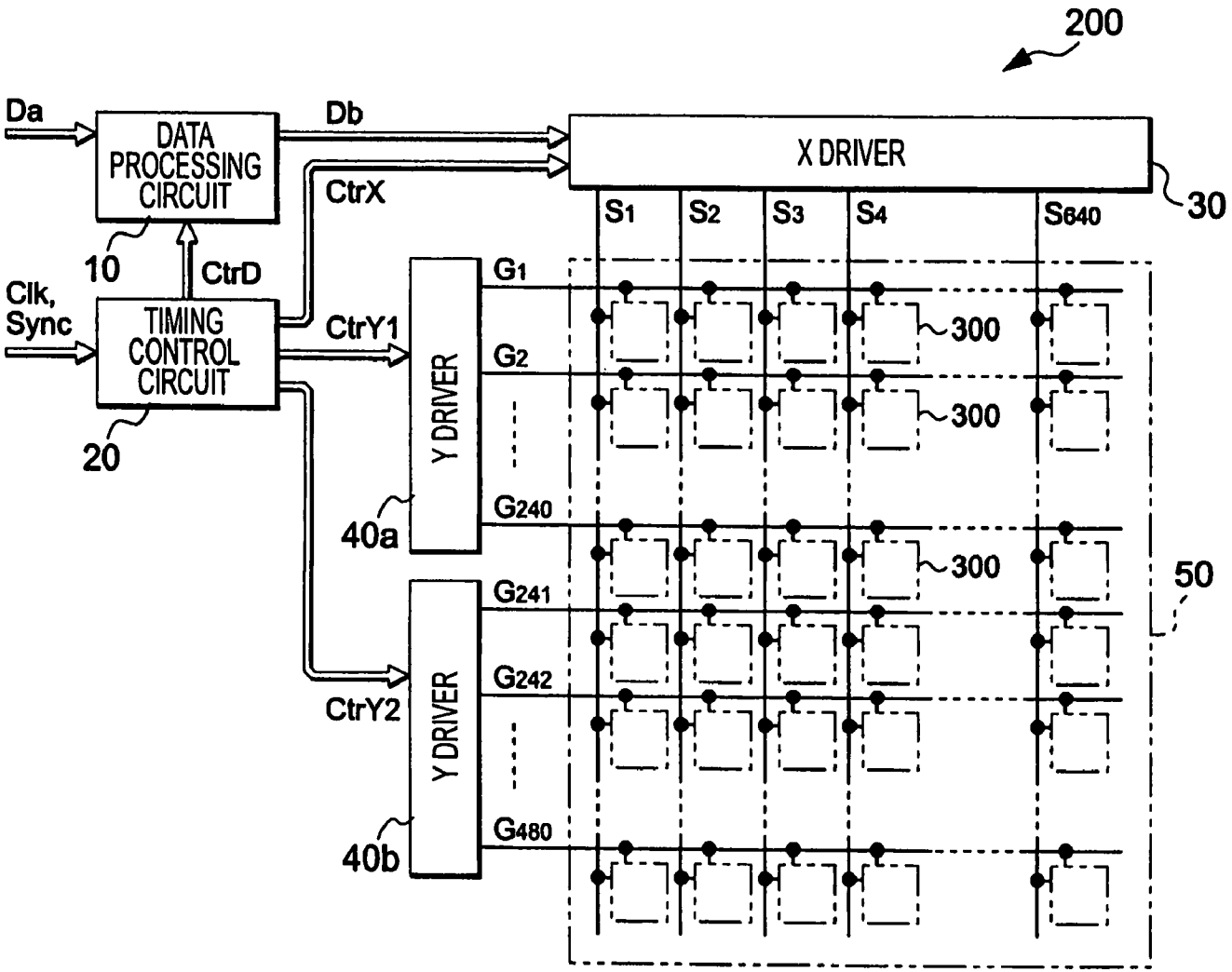
FIG. 1 is a schematic view illustrating configuration of a liquid crystal display device according to a first embodiment of the invention.

First, a first embodiment as a basic aspect of the present invention will be described. FIG. 1 is a schematic view illustrating configuration of a liquid crystal display device 200 according to the first embodiment.

As shown in FIG. 1, the liquid crystal display device 200 as an example of an electro-optical display device includes, as main components, a data processing circuit 10, a timing control circuit 20, an X driver 30, Y drivers 40*a* and 40*b*, and a liquid crystal display panel 50.

Of these components, the liquid crystal display panel 50 includes 480 rows of scan lines $G_1$, $G_2$, . . . , $G_{240}$, $G_{241}$, $G_{242}$, . . . , $G_{480}$ extending in a horizontal direction and 640 columns of signal lines $S_1$, $S_2$, $S_3$, . . . , $S_{640}$ extending in a vertical direction. In addition, pixels 300 are arranged at intersections of the 480 rows of scan lines and the 640 columns of 640 signal lines. Accordingly, in this embodiment, the pixels are arranged in the form of a 480 (in row)×640 (in column) matrix. However, in the invention, the pixels are not limited to this arrangement.

Figure 2A:
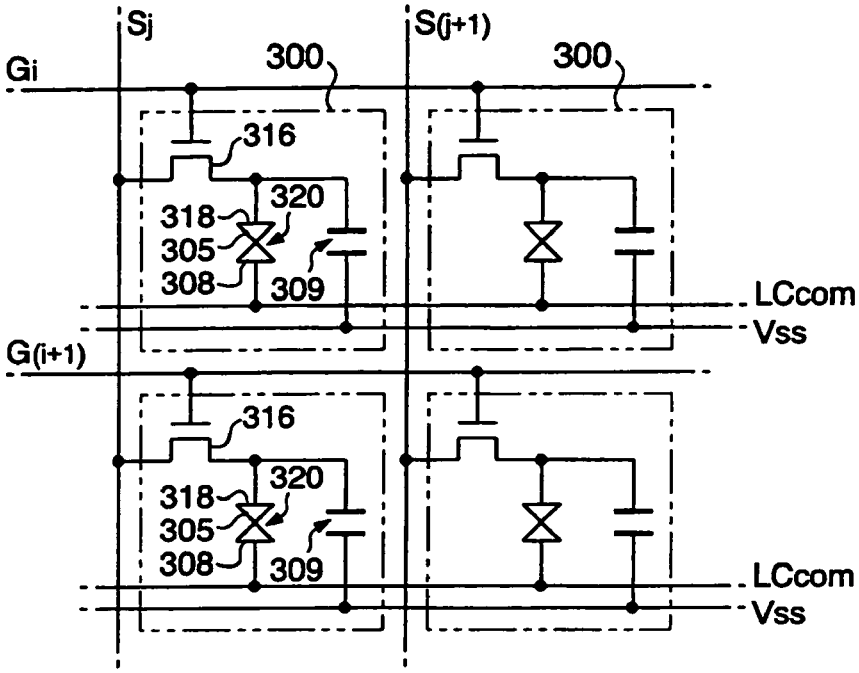
FIG. 2A is a view illustrating configuration of pixels in the liquid crystal display device.

Now, configuration of the pixels 300 will be described with reference to FIG. 2. FIG. 2A is a view illustrating an electrical configuration of the pixels 300, showing four 2×2 pixels arranged at intersections of an i-th row, an adjacent (i+1)-th row, a j-th column and an adjacent (j+1)-th column. Here, i and (i+1), which are integral numbers generally indicating rows at which the pixels 300 are arranged, denote more than 1 but less than 480, and j and (j+1), which are integral numbers generally indicating columns at which the pixels 300 are arranged, denote more than 1 but less than 640.

As shown in FIG. 2A, each pixel 300 includes a liquid crystal capacitor 320 and a thin film transistor (TFT) 316.

Here, since the pixels 300 have the same configuration, a pixel located at an i-th row and a j-th column will be described representatively. In the pixel located at the i-th row and the j-th column, a gate of a TFT 316 is connected to a scan line $G_i$ at the i-th row, a source thereof is connected to a signal line Sj at the j-th column, and a drain thereof is a pixel electrode 318, which is one end of the liquid crystal capacitor 320.

In addition, the other end of the liquid crystal capacitor 320 is connected to a common electrode 308. The common electrode 308 is common throughout the entire pixel 300. In this embodiment, the common electrode 308 maintains a predetermined voltage LCcom in a time manner.

As well known in the related art, the liquid crystal display panel 50 is formed of a pair of substrates, i.e., an element substrate and a counter substrate, with a predetermined gap therebetween. In addition, the element substrate has an electrode forming surface on which the scan lines, the signal lines, the TFT 316, and the pixel electrode 318 are formed. This electrode forming surface is bonded to be opposite to the common electrode 308 formed on the counter substrate. In addition, liquid crystal 305 is interposed between the pixel electrode 318 and the common electrode 308. Accordingly, each pixel includes the liquid crystal capacitor 320, which is composed of the pixel electrode 318, the common electrode 308 and the liquid crystal 305.

On opposite surfaces of both the substrates are individually formed alignment films which are subject to a rubbing treatment such that longitudinal axes of liquid crystal molecules are consecutively twisted by about 90 degrees, for example. On the other hand, on back sides of both the substrates are respectively formed polarizers with their polarization axes aligned in an orientation direction.

Accordingly, if an effective value of voltage applied to the liquid crystal capacitor 320 is 0 V, since light passing between the pixel electrode 318 and the common electrode 308 is rotated by about 90 degrees due to the twisting of the liquid crystal molecules, transmittance ratio of the light becomes maximal. On the other hand, as the effective voltage increases, the liquid crystal molecules are tilted in the direction of an electric field, and accordingly, optical rotatory power is vanished. As a result, the amount of transmission light is reduced and transmittance ratio is minimized (normally white mode).

Accordingly, by applying a select voltage to the scan lines to turn on the TFT 316 while applying a voltage depending on gray scale, which is high (positive) or low (negative) with respect to the voltage LCcom of the common electrode 308, to the pixel electrode 318 by the signal lines and the turned-on TFT 316, it is possible to maintain the effective voltage depending on the gray scale predetermined at the liquid crystal capacitor 320.

In addition, while the TFT 316 is turned off when a non-select voltage is applied to the scan lines, considerable charges are leaked out of the liquid crystal capacitor 309 since an off resistance of the turned-off TFT 316 does not become infinity, ideally. A storage capacitor 309 is formed for each pixel in order to lessen an effect of this off-leak. The storage capacitor 309 has one end connected to the pixel electrode (the drain of TFT 316) and the other end is commonly grounded to the entire pixels. The storage capacitor 309 is provided in parallel to the liquid crystal capacitor 320, while a voltage across the storage capacitor 309 is maintained at a power voltage Vss (0 volt), for example, with time.

Returning to FIG. 1, the data processing circuit 10 acquires image data Da from an external super ordinate device. The image data Da, which is data defining gray scale levels of the 480×640 pixels, is sequentially supplied in synchronization with a synchronization signal Sync and a clock signal Clk. In this embodiment, according to the image data Da, the gray scale levels of the pixels are defined by 16 steps from a gray scale value 0 indicating the darkest state to a gray scale value 15 indicating the brightest state, for example. In addition, in this embodiment, the image data Da includes a signal specifying whether each pixel is marked with positive polarity or negative polarity. Here, in this embodiment, considering the same pixel, a positive mark and a negative mark are alternately reversed for each of the plurality of frames. The reason for alternately reversing the mark polarity between the positive and negative polarities is to prevent the liquid crystal 305 from being deteriorated due to direct application of current components.

The data processing circuit 10 performs a process, as will be described below, for the acquired image data Da, and outputs (processed) image data Db by defining a voltage to be applied to the pixel electrode, that is, a voltage having a specified polarity and depending on gray scale, for each pixel. In addition, in this embodiment, as will be described below, one frame is divided into two fields and the image data Db defines a voltage for each of the two fields for each pixel.

The timing control circuit 20 generates a control signal CtrX for controlling a horizontal scan by the X driver 30, control signals CtrY1 and CtrY2 for controlling a vertical scan by the Y drivers 40*a* and 40*b*, and a control signal CtrD for controlling a processing timing in the data processing circuit 10 from the synchronization signal Sync and the clock signal Clk supplied from an external supply device.

The Y driver 40*a* is designed to scan the scan lines G1, G2, . . . , G240 in the upper half of the 480 row scan lines based on the control signal CtrY1 and the Y driver 40*b* is designed to scan the scan lines $G_{241}$, $G_{242}$, . . . , $G_{480}$ in the lower half of the 480 row scan lines based on the control signal CtrY2.

In the first embodiment, one frame is equally divided into two fields when driving the liquid crystal display panel 50. Here, one frame refers to an interval required to display one image defined by the image data Da and is typically about 17 msec (the reciprocal of a frequency 60 Hz). In addition, to distinguish between the two fields constituting one frame, the previous one is referred to as a first field and the later one is referred to as a second field.

Figure 3:
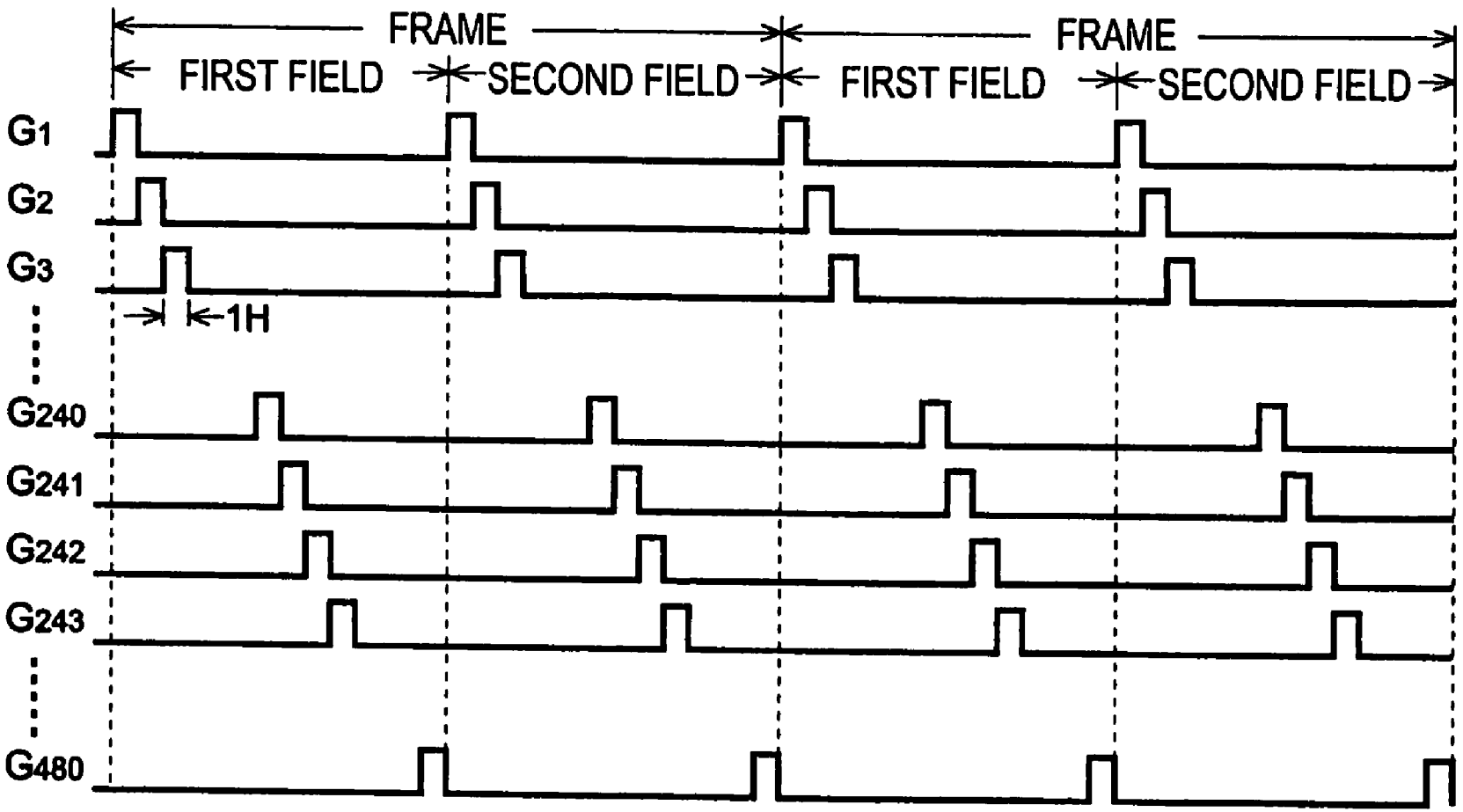
FIG. 3 is a view illustrating an example of voltage waveforms for scan lines in the liquid crystal display device.

In such driving, the Y drivers 40*a* and 40*b* scan the 480 row scan lines in one frame sequentially, as shown in FIG. 3, for example.

That is, the scan lines G1, G2, . . . , G240 are scanned sequentially in the first half of the first field and the scan lines $G_{241}$, $G_{242}$, . . . , $G_{480}$ are scanned sequentially in the second half of the first field. This configuration is the same as at the second field. Accordingly, in each of the first and second fields, a scan line is exclusively selected row-by-row sequentially from the top, and at the same time, a high (H) level signal is supplied to the selected scan line. As such, in this embodiment, a voltage is marked twice per frame in each pixel 300.

The X driver 30 is designed to latch beforehand the image data Db equivalent to one row of pixels located at the selected scan line, based on the control signal CtrX, and at the same time, convert the latched image data Db to an analog voltage defined in the image data Db and supply the analog voltage to the signal lines $S_1$, $S_2$, $S_3$, . . . , $S_{640}$ according to the selection of the scan lines.

Now, the concept of a gray scale voltage, which is a voltage applied to the pixel electrode 318, according to a gray scale value and a mark polarity, will be described in reference to FIG. 6.

As described above, since this embodiment employs the normally white mode, if the gray scale voltage has the positive polarity, it becomes a high potential with respect to the voltage LCcom of the common electrode 308 as the gray scale value becomes small (that is, as a dark mode is designated). On the other hand, if the gray scale voltage has the negative polarity, it becomes a low potential with respect to the voltage LCcom as the gray scale value becomes small.

In other words, when the gray scale voltage is applied to the pixel electrode 318, the pixel has brightness corresponding to the gray scale value designated in the image data Da.

A voltage having the positive polarity corresponding to each gray scale value and a voltage having the negative polarity corresponding to each gray scale value have a symmetrical relationship with respect to the voltage LCcom. In addition, the voltage Vss is a ground potential at a low value of a power voltage, as described above. That is, the voltage Vss actually becomes 0 V. In this embodiment, this ground potential is assumed as the reference of a voltage without further explanation.

In addition, a magnitude relation of gray scale voltages for two gray scale values is reversed if their mark polarities are reversed. For example, a gray scale voltage corresponding to a gray scale value of 1 is higher than a gray scale voltage corresponding to a gray scale value of 3 if the mark polarity is positive, and, on the contrary, the former is lower than the later if the mark polarity is negative.

Figure 6:
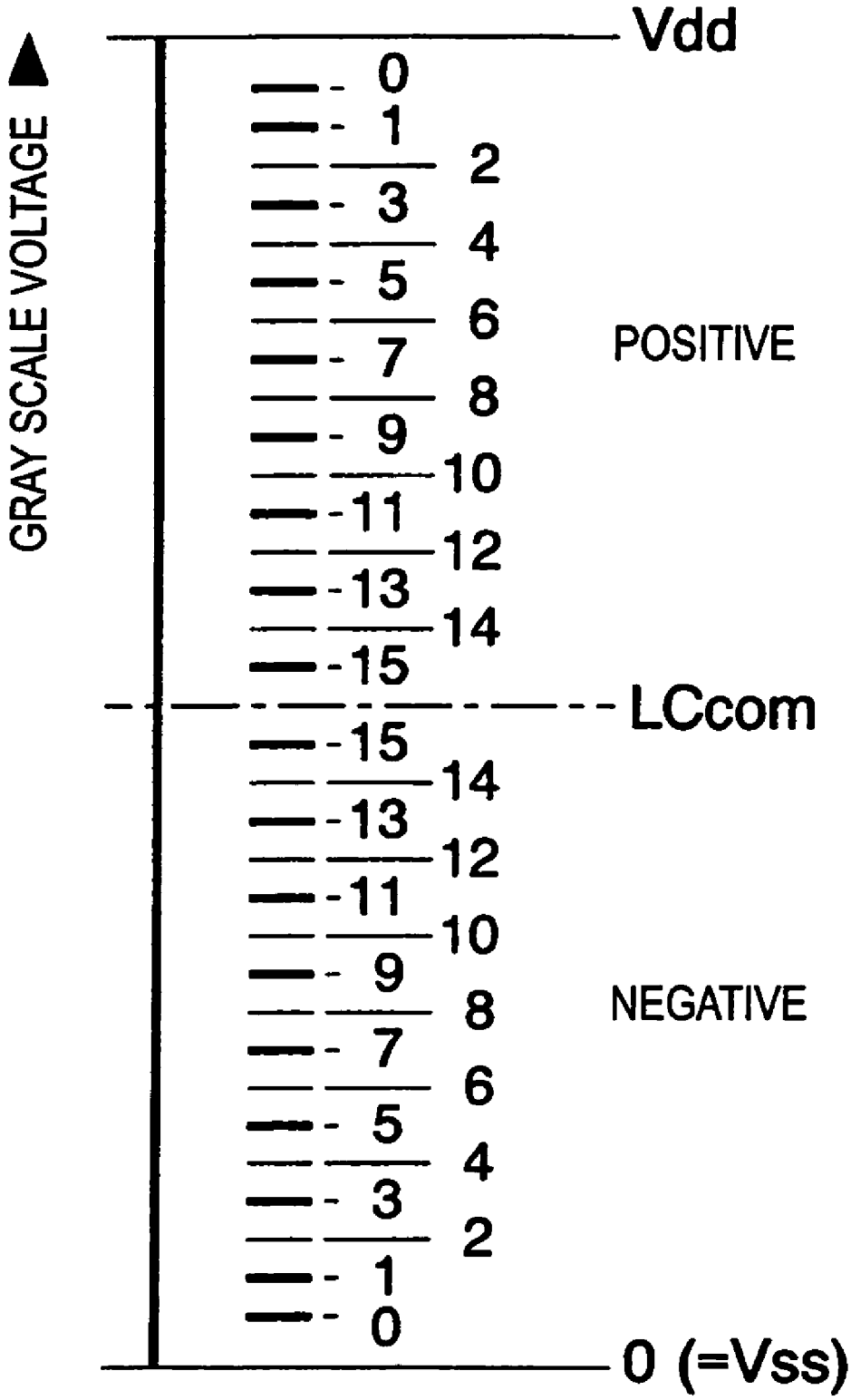
FIG. 6 is a view illustrating relationship between gray scale voltages in the liquid crystal display device.

Here, in this embodiment, voltages actually outputtable by the X driver 30 are just positive and negative voltages corresponding to gray scale values of 0, 1, 3, 5, 7, 9, 11, 13 and 15 indicated by thick lines in FIG. 6. In this embodiment, gray scale values other than these gray scale values indicated by the thick lines are pseudo gray scale values using two different gray scale levels (voltages) in the first and second fields.

In addition, while a voltage as a reference of the positive and negative polarities is the voltage LCcom in this embodiment, in some cases, this reference may be slightly displaced from the voltage LCcom in order to prevent effective voltages from becoming different from one another depending on their polarities due to pushdown of TFTs.

Figure 4:
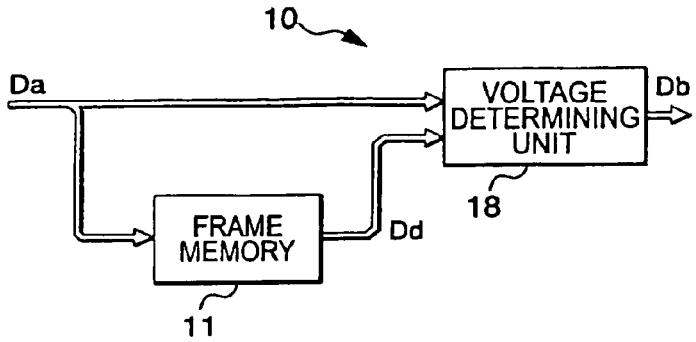
FIG. 4 is a view illustrating configuration of a data processing circuit in the liquid crystal display device.

Next, the data processing circuit 10 will be described in detail. FIG. 4 is a block view illustrating a detailed configuration of the data processing circuit 10.

In this figure, a frame memory 11 is designed to sequentially store the image data Da supplied from the external super ordinate device, read the stored image data Da after one frame has lapsed, and output the read image data Da as image data Dd. That is, the frame memory 11 delays the image data Da by only one frame and outputs the image data Dd before the image data Da by one frame.

A voltage determining unit 18 acquires the image data Da supplied directly from the external super ordinate device and the image data Dd read from the frame memory 11 and processes the acquired image data Da and Dd, as will be described below, in order to determine voltages for representing gray scale levels of the pixels and output the image data Db for specifying the voltages.

Here, while the image data Da from the external super ordinate device is supplied in a dot-sequence manner over one frame of the 480×640 pixels, the one frame is divided into the first and second fields in this embodiment, as described above. To this end, the voltage determining unit 18 processes the image data Da corresponding to any pixel, and, when the image data Db is output, outputs the image data Db specifying a voltage in the first field if the first field is scanned in the liquid crystal display panel 50 and outputs the image data Db specifying a voltage in the second field if the second field is scanned.

That is, of the image data Db, a voltage for the first field is equivalent to a first effective voltage and a voltage for the second field is equivalent to a second effective voltage.

Figure 5:
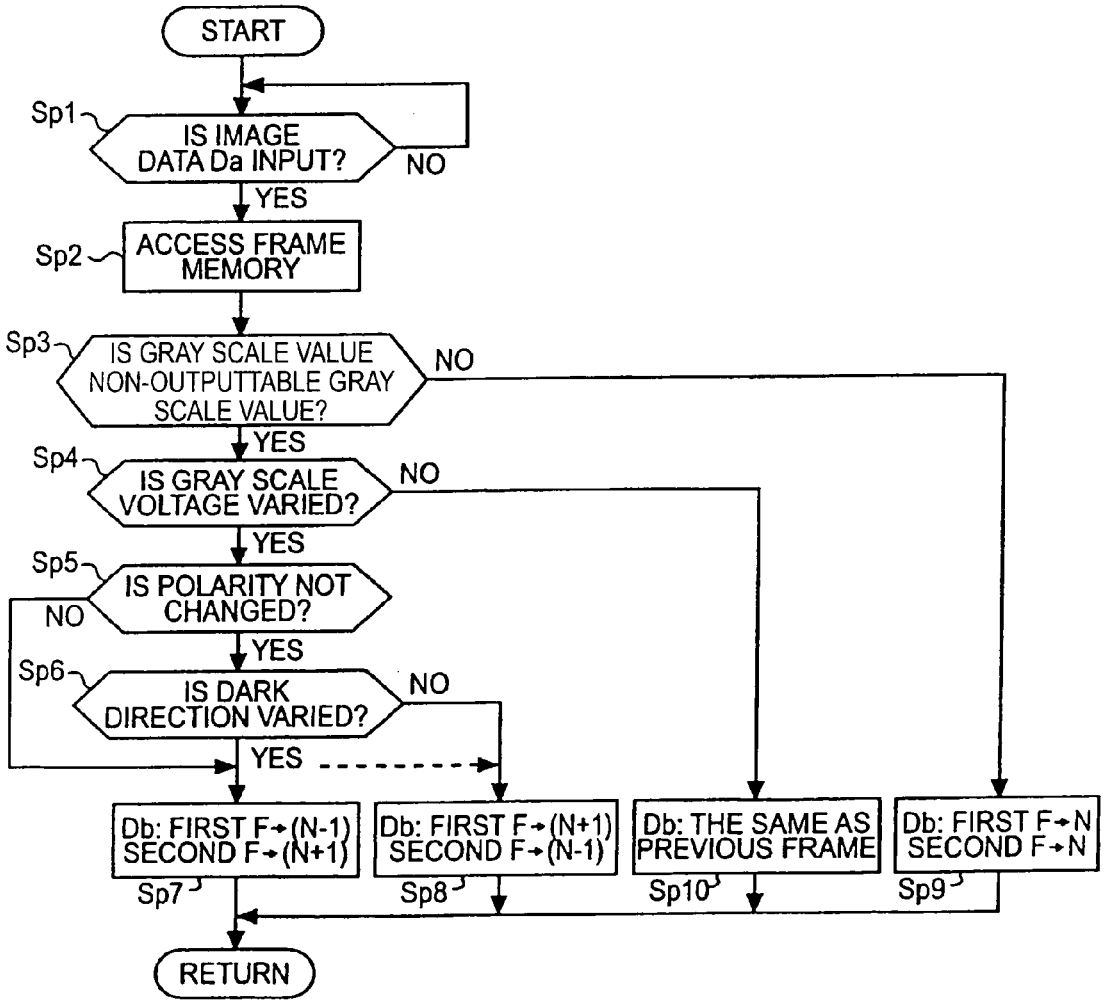
FIG. 5 is a view illustrating operation of a voltage determining unit in the data processing circuit.

Next, a voltage determining process in the voltage determining unit 18 will be described. FIG. 5 is a flow chart illustrating contents of a voltage determining process. Even though the voltage determining process is described here as the image data Da of a pixel at an i-th row and a j-th column as a representative, this process is actually performed in the dot-sequence manner for all 480×640 pixels.

First, when the image data Da corresponding to the pixel at the i-th row and j-th column are input from the external super ordinate device (Step Sp1), the voltage determining unit 18 obtains the image data Dd corresponding to the pixel at the same i-th row and j-th column from the frame memory 11, that is, the image data Dd before the image data Dd by one frame (Step Sp2). Also, since the image data Da input from the external super ordinate device in the current frame is stored in the frame memory 11, the image data Da needs to be used for the next frame.

Next, the voltage determining unit 18 determines whether the image data Da supplied from the external super ordinate device corresponds to a first case of specifying one of the gray scale values of 2, 4, 6, 8, 10, 12 and 14 (that is, in a case of representing the pseudo gray scale values) or a second case of specifying one of the gray scale values of 0, 1, 3, 5, 7, 9, 11, 13 and 15 (that is, in a case of not representing the pseudo gray scale values) (Step Sp3).

In the first case, the voltage determining unit 18 additionally determines whether or not a gray scale voltage specified in the image data Da supplied directly from the external super ordinate device is varied from a gray scale voltage specified in the image data Dd before the image data Da by one frame (Step Sp4). As described above, the gray scale voltage refers to voltages at an upper side according to the gray scale values with respect to the voltage LCcom if a positive mark is designated, and refers to voltages at a lower side according to the gray scale values with respect to the voltage LCcom if a negative mark is designated (see FIG. 6).

Accordingly, assuming that an output voltage of the x driver 30 has no restriction, it is determined in Step Sp4 whether or not a voltage to be applied to a pixel electrode at the i-th row and j-th column is varied over a range from a frame of the image data Dd supplied from the frame memory (that is, the previous frame) to a frame of the image data Da supplied from the external super ordinate device (that is, the current frame).

In addition, if the gray scale voltages are varied, the voltage determining unit 18 determines whether or not a polarity reversion occurs (Step Sp5). Such determination is made because the gray scale voltages are varied if the polarity reversion occurs even if the gray scale values are not varied over the range from the previous frame to the current frame.

If there is no variation in the polarity, the voltage determining unit 18 determines whether or not the direction of variation of the gray scale values is a direction at which it gets dark (that is, a direction at which the gray scale values are lowered) (Step Sp6).

Here, a gray scale value specified in the image data Da is assumed as N. At this time, if the gray scale value is in the direction at which it gets dark, the voltage determining unit 18 outputs the image data Db, with a gray scale value in the first field as (N−1) and a gray scale value in the second field as (N+1), for the pixel at the i-th row and j-th column (Step Sp7). In addition, even if there is no variation in the gray scale values, the gray scale voltages are varied when the polarity is reversed. On this account, if a result of the determination in Step Sp5 is NO, the process proceeds to Step Sp7 where the voltage determining unit 18 outputs the same image data Db.

On the other hand, if the gray scale value is in the direction at which it gets bright, the voltage determining unit 18 outputs the image data Db, with a gray scale value in the first field as (N+1) and a gray scale value in the second field as (N−1), for the pixel at the i-th row and j-th column (Step Sp8).

On the other hand, if it is determined in Step Sp3 that the image data Da correspond to the second case, when the gray scale value specified in the image data Da is assumed as N, the voltage determining unit 18 outputs the image data Db, with gray scale values in the first and second fields as N, for the pixel at the i-th and j-th column (Step Sp9).

In addition, if it is determined in Step Sp4 that there is no variation in the gray scale voltages, the voltage determining unit 18 outputs the same image data Db as the previous frame for the pixel at the i-th row and j-th column (Step Sp10).

In addition, in Steps Sp7 and Sp8 (Sp10 as circumstance require), the gray scale values specified in the image data Db are modified from the gray scale values specified in the image data Da, however, the mark polarities are output as they are, with no modification.

When one of Steps Sp7 to Sp10 is completed, the process for the pixel at the i-th and j-th column is ended, and then, when image data Da corresponding to a pixel at a next i-th and (j+1)-th column is input, the above-described process is repeated.

On the other hand, in the first field of the current frame, the scan lines $G_1, G_2, G_3, \ldots, G_{480}$ become an H level by the Y drivers 40*a* and 40*b* in the order shown in FIG. 3. Before the scan line $G_1$ in the first field becomes an H level, the X driver 30 is supplied with image data Db, which correspond to the first field, of the image data Db at a first row and first column, a first row and second column, a first row and third column, . . . , a first and 640-th column. Then, in time when the scan line $G_1$ becomes the H level, the X driver 30 converts the image data Db at the first row and first column, the first row and second column, the first row and third column, . . . , the first and 640-th column to an analog voltage specified in the mark polarity and supplies the converted image data to the signal lines $S_1, S_2, S_3, \ldots, S_{640}$.

When the scan line $G_1$ is at H level, since the TFTs 316 in the pixels 300 at the first row are turned on, for example in the first column, a voltage supplied to the signal line $S_1$ is applied to the pixel electrode 318 at the first row and first column and accordingly, a voltage of an aimed gray scale value is marked for the liquid crystal capacitor 320. This is true of pixels at the second to 640-th columns.

Next, a scan line $G_2$ becomes an H level. At this time, similar to when the scan line $G_1$ becomes the H level, a voltage of a gray scale value specified in the image data Db at a second row and first column, a second row and second column, a second row and third column, . . . , a second and 640-th column is marked for the liquid crystal capacitor 320. Likewise, scan line $G_3, G_4, \ldots, G_{480}$ become an H level in order, and voltages according to gray scale values specified in the image data Db are marked for the liquid crystal capacitor 320.

Accordingly, each pixel maintains gray scale determined in the voltage determining unit 18 over an interval up to a next mark, that is, an interval (field) equivalent to half of one frame.

In the second field subsequent to the first field, like the first field, the scan line $G_1, G_2, G_3, \ldots, G_{480}$ become the H level and voltages according to gray scale values of the image data Db are marked for each pixel. However, it does not mean that the second field has the same gray scale values as the first field for each pixel (Step Sp7 or Sp8). When the first field has gray scale values different from those of the second, an average gray scale of both fields will be perceived by a user when viewed through one frame.

Next, in the first embodiment, marks obtainable when gray scale values or mark polarities of the pixels are varied from an immediate previous frame will be considered.

Figure 7A:
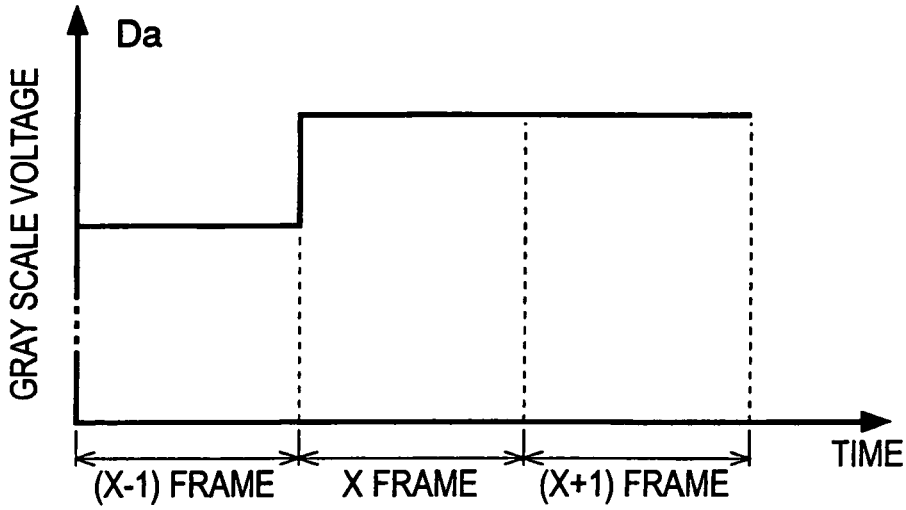
FIG. 7A is a view illustrating variation of gray scale voltages in the liquid crystal display device.
Figure 7B:
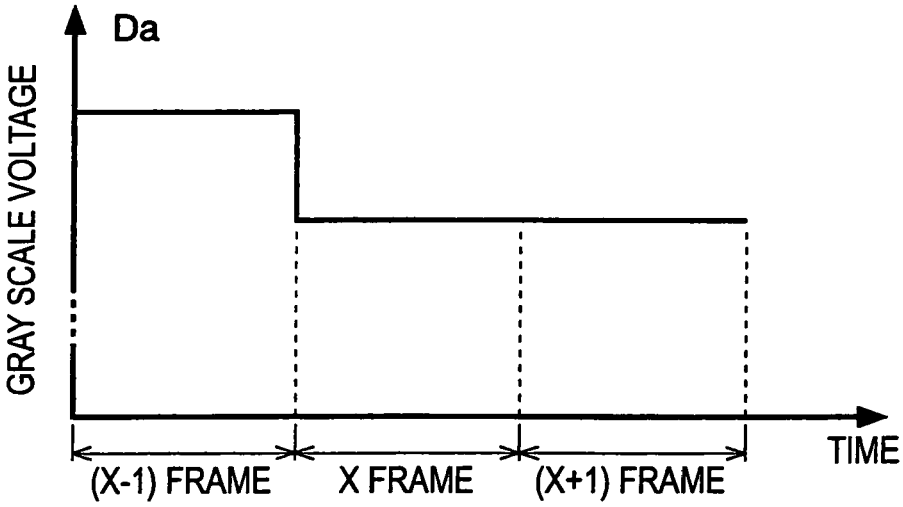
FIG. 7B is a view illustrating variation of gray scale voltages in the liquid crystal display device.

FIGS. 7A and 7B are views illustrating an example of variation of gray scale voltages according to the gray scale values specified in the image data Da and the mark polarities. In these figures, a horizontal axis denotes time and a vertical axis denotes a gray scale voltage.

In these figures, since only the variation of the gray scale values specified in the image data Da is considered, there is no need to consider whether or not the gray scale voltages are voltages outputtable from the x driver 30. However, if the gray scale voltages specified in the image data Db are considered, the gray scale voltages are limited to voltages outputtable from the X driver 30, that is, voltages corresponding to the gray scale value of 0 and odd gray scale values.

FIG. 7A shows a state where the gray scale voltages specified in the image data Da increase over a range from an (X−1) frame to an X frame and are not varied over a range from an X frame to an (X+1) frame. Here, since the image data Da specifies the gray scale values and mark polarity of the pixels, as cases where the gray scale voltages increase over the range from the (X−1) frame to the X frame, three cases may be considered as follows:

(1) a case where the mark polarity is varied from a positive polarity to a negative polarity, (2) a case where the mark polarity is not varied from the positive polarity but the gray scale values decrease (i.e., are varied in a direction in which it becomes dark), (3) a case where the mark polarity is not varied from the negative polarity but the gray scale values increase (i.e., are varied in a direction in which it becomes bright).

Next, FIG. 7B shows a state where the gray scale voltages decrease over the range from the (X−1) frame to the X frame and are not varied over the range from the X frame to the (X+1) frame. As cases where the gray scale voltages decrease over the range from the (X−1) frame to the X frame, three cases may be considered as follows:

(4) a case where the mark polarity is varied from the positive polarity to the negative polarity, (5) a case where the mark polarity is not varied from the negative polarity but the gray scale values decrease (i.e., are varied in a direction in which it becomes dark), (6) a case where the mark polarity is not varied from the positive polarity but the gray scale values increase (i.e., are varied in a direction in which it becomes bright).

In the end, the variation of the gray scale voltages are varied may be classified into the above six cases (1) to (6).

The above cases (1) to (4) are independent of whether or not the gray scale values are predetermined. This embodiment is carried out in the normally white mode, as described above.

Next, assuming that the X frame is the current frame, if the gray scale values specified in the image data Da are an even number except 0, a result of the determination in Step Sp3 is 'YES'. Here, since the variation of the gray scale voltages is considered, a result of the determination in Step Sp4 is also 'YES'.

Subsequently, a case where a result of the determination in Step Sp5 is 'NO' corresponds to cases (1) and (4), and a case where a result of the determination in Step Sp5 is 'YES' corresponds to cases (2), (3), (5) and (6). Of these cases, a case where a result of the determination in Step Sp6 is 'YES' corresponds to cases (2) and (5).

In the end, in cases (1), (2), (4) and (5), through Step Sp7, the gray scale value of the image data Db becomes a gray scale value (N−1), which is smaller by 1 than the gray scale value N specified in the image data Da, for the first field, and becomes a gray scale value (N+1), which is larger by 1 than the gray scale value N, for the second field. Here, since the gray scale value N specified in the image data Da is an even gray scale value except 0, it is not a voltage outputtable from the X driver 30. However, since the gray scale values smaller and larger by 1 than the gray scale value N are an odd gray scale value, they are voltages outputtable from the x driver 30.

Figure 8A:
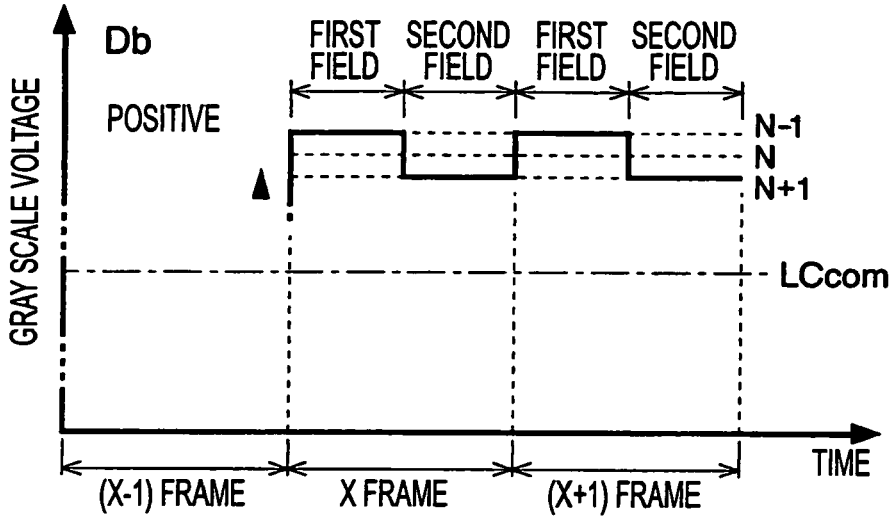
FIG. 8A is a view illustrating an example of gray scale voltages determined in the liquid crystal display device.

In cases (1) and (2), since the mark polarity is positive, the gray scale voltages specified in the image data Db in the X frame are as shown in FIG. 8A. More specifically, the gray scale voltages specified in the image data Db of the X frame become a voltage corresponding to the gray scale value (N−1) shifted in an increasing direction as a variation direction, rather than a voltage corresponding to the gray scale value N, for the first field, and become a voltage corresponding to the gray scale value (N+1) shifted in a decreasing direction opposite to the variation direction, rather than the voltage corresponding to the gray scale value N, for the second field.

Figure 9A:
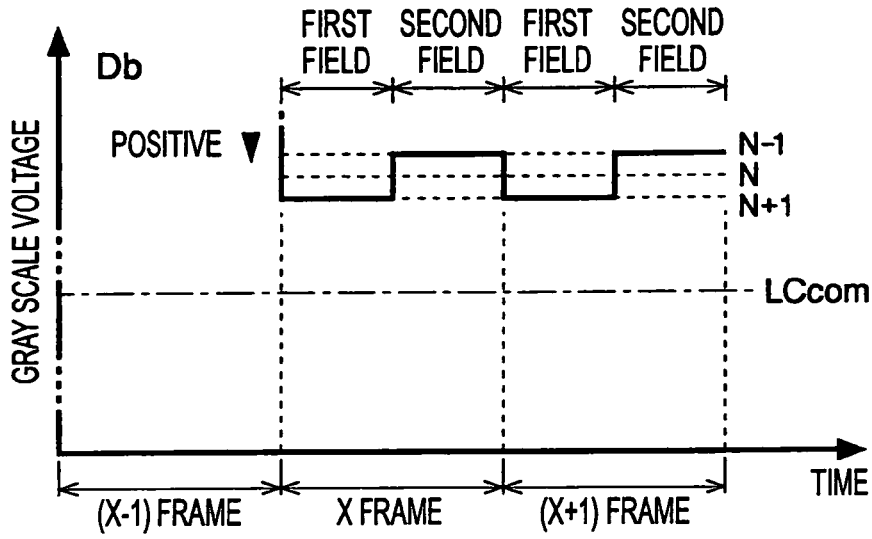
FIG. 9A is a view illustrating an example of gray scale voltages determined in the liquid crystal display device.
Figure 9B:
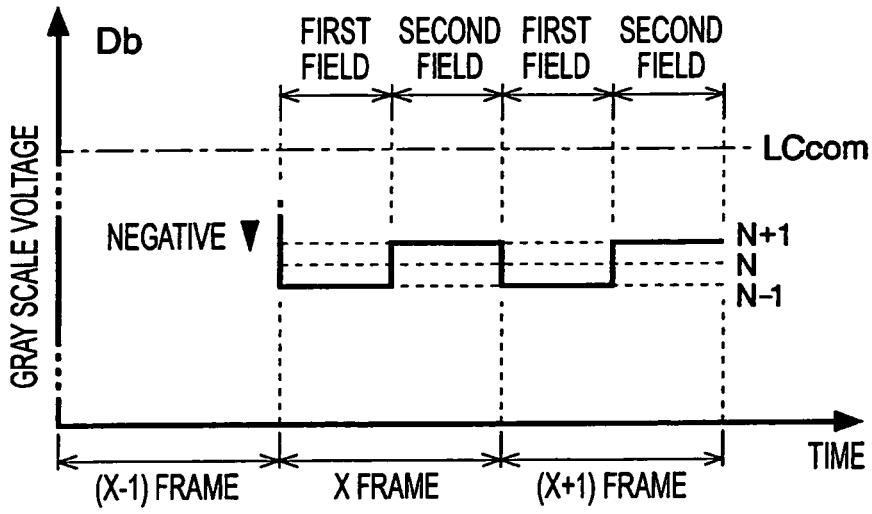
FIG. 9B is a view illustrating an example of gray scale voltages determined in the liquid crystal display device.

In addition, in cases (4) and (5), since the mark polarity is negative, the gray scale voltages specified in the image data Db in the X frame are as shown in FIG. 9B. More specifically, the gray scale voltages specified in the image data Db of the X frame become a voltage corresponding to the gray scale value (N−1) shifted in a decreasing direction as a variation direction, rather than the voltage corresponding to the gray scale value N, for the first field, and become a voltage corresponding to the gray scale value (N+1) shifted in an increasing direction opposite to the variation direction, rather than the voltage corresponding to the gray scale value N, for the second field.

On the other hand, a case where a result of the determination in Step Sp6 is 'NO' corresponds to cases (3) and (6).

In cases (3) and (6), through Step Sp8, the gray scale value of the image data Db becomes a gray scale value (N+1), which is larger by 1 than the gray scale value N specified in the image data Da, for the first field, and becomes a gray scale value (N−1), which is smaller by 1 than the gray scale value N, for the second field.

Figure 8B:
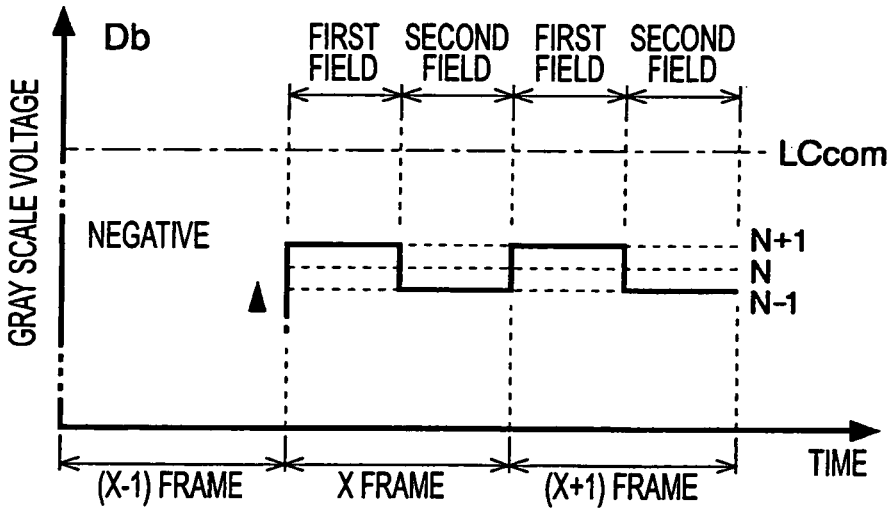
FIG. 8B is a view illustrating an example of gray scale voltages determined in the liquid crystal display device.

In case (3), since the mark polarity is negative, the gray scale voltages specified in the image data Db in the X frame are as shown in FIG. 8B. More specifically, the gray scale voltages specified in the image data Db of the X frame become a voltage corresponding to the gray scale value (N+1) shifted in an increasing direction as a variation direction, rather than the voltage corresponding to the gray scale value N, for the first field, and become a voltage corresponding to the gray scale value (N−1) shifted from the voltage corresponding to the gray scale value (N+1) in a decreasing direction opposite to the variation direction, rather than the voltage corresponding to the gray scale value N, for the second field.

In addition, in case (6), since the mark polarity is positive, the gray scale voltages specified in the image data Db in the X frame are as shown in FIG. 9A. More specifically, the gray scale voltages specified in the image data Db of the x frame become a voltage corresponding to the gray scale value (N+1) shifted in a decreasing direction as a variation direction, rather than the voltage corresponding to the gray scale value N, for the first field, and become a voltage corresponding to the gray scale value (N−1) shifted in an increasing direction opposite to the variation direction, rather than the voltage corresponding to the gray scale value N, for the second field.

Figure 10A:
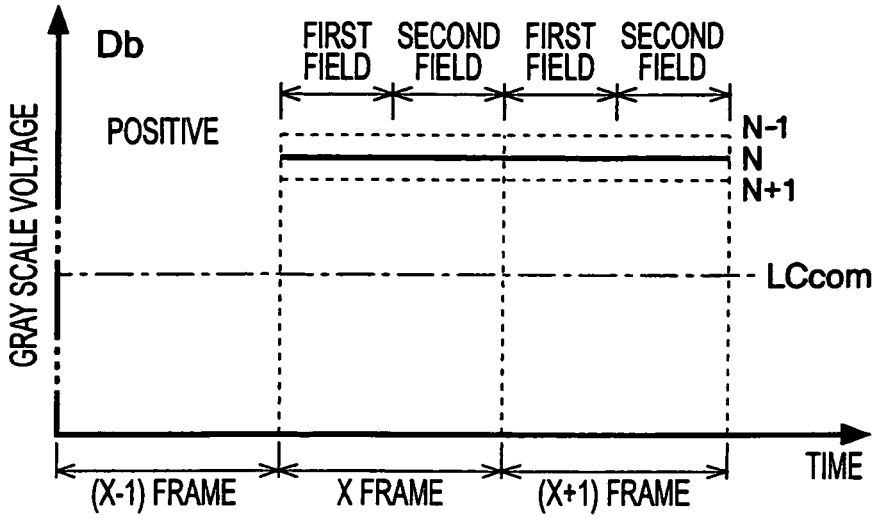
FIG. 10A is a view illustrating an example of gray scale voltages determined in the liquid crystal display device.
Figure 10B:
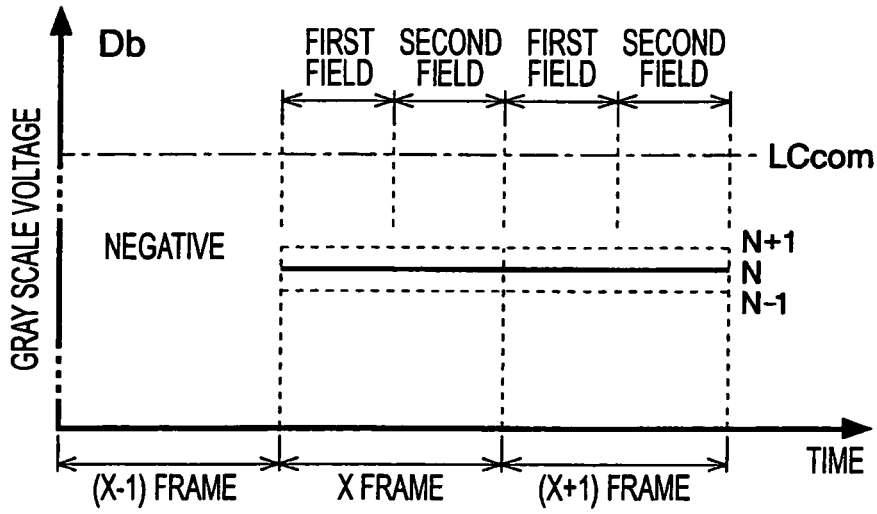
FIG. 10B is a view illustrating an example of gray scale voltages determined in the liquid crystal display device.

However, when the gray scale value specified in the image data Da in the X frame is an odd number, since the gray scale value is a voltage outputtable from the X driver 30, in this embodiment, the gray scale value of the image data Db is the gray scale value N specified in the image data Da for the first and second fields through Step Sp9, regardless of whether or not the gray scale voltages are varied. On this account, when the gray scale value N specified in the image data Da in the X frame is an odd number, the gray scale voltage specified in the image data Db becomes a voltage corresponding to the odd gray scale value N over the first and second fields, as shown in FIG. 10A if the gray scale voltage is positive and as shown in FIG. 10B if the gray scale voltage is negative.

In a case where the gray scale value specified in the image data Da is an even number except 0, when the gray scale voltage is not varied (that is, when a result of the determination in Step Sp4), in this embodiment, the image data Db in an immediate previous frame is again output through Step Sp10. In FIGS. 8A, 8B, 9A, 9B, 10A and 10B, since the gray scale voltage is not varied over the range from the X frame to the (X+1) frame, the gray scale voltage specified in the image data Db of the (X+1) frame is the same as the X frame for the first and second fields.

According to the first embodiment, when the gray scale value or the mark polarity is varied, since an excess is offset with a voltage marked to the liquid crystal capacitor as an excessive voltage shifted in the variation direction, rather than a voltage corresponding to the gray scale value specified in the image data Da, in the first field and as a voltage shifted in a direction opposite to the variation direction, rather than the voltage corresponding to the gray scale value specified in the image data Da, in the subsequent second field, it is possible to improve the responsiveness of the liquid crystal 305 having a relatively slow response speed. In addition, in this embodiment, even when gray scale to be represented for one frame corresponds to a voltage which can not be output from the X driver 30, since the gray scale includes pseudo values represented in the first and second fields using the gray scale values corresponding to the voltages outputtable from the X driver 30, it is possible to increase the number of representable gray scale levels.

In addition, in this embodiment, in only a case where the gray scale value specified by the image data Da in a frame to be processed is not a gray scale value corresponding to the outputtable voltage of the X driver 30, the gray scale voltage of the first field becomes different from the gray scale voltage of the second field through Step Sp7 or Sp8. However, even though the gray scale value specified by the image data Da is the gray scale value corresponding to the outputtable voltage of the X driver 30, when the gray scale voltage of the first field becomes different from the gray scale voltage of the second field through Step Sp7 or Sp8, improvement in the response speed can be expected. On this account, regardless of whether or not the gray scale voltages specified by the image data Da for the frame to be processed are the outputtable voltage of the X driver 30, it may be configured that the gray scale voltage shifted in the variation direction of the gray scale voltage from the previous frame is applied to the first frame and the gray scale voltage shifted in the opposite direction to the variation direction is applied to the subsequent field (this configuration will be described in detail in a fourth embodiment, which will be described later).

Here, in a case where it is not determined in Step Sp3 whether or not the gray scale value specified by the image data Da is the gray scale value corresponding to the outputtable voltage of the X driver 30, if the gray scale value specified by the image data Da of the frame to be processed is, for example, a gray scale value of 0 or 15 (minimum or maximum value), the gray scale value in the first field can not become different from the gray scale value in the second field. Accordingly, instead, it is preferable that it may be determined in Step Sp3 whether or not the gray scale value specified by the image data Da is the gray scale value corresponding to the outputtable voltage of the x driver 30.

Figure 11:
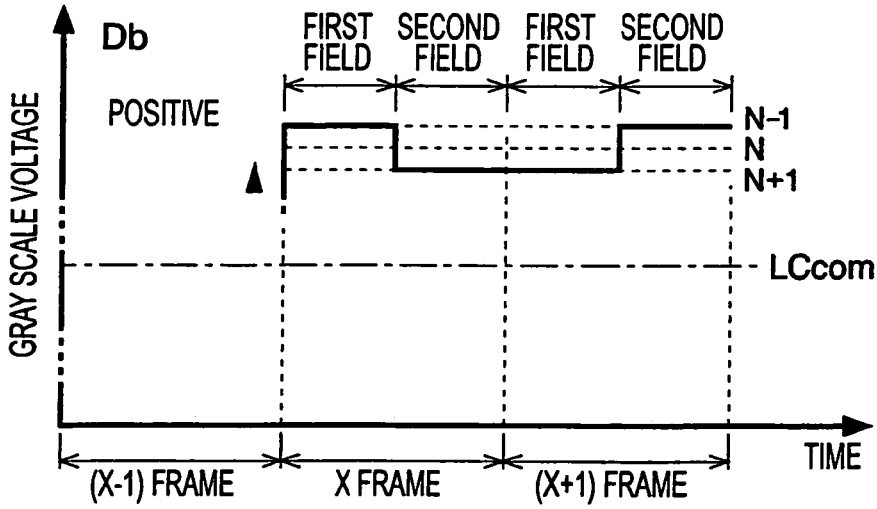
FIG. 11 is a view illustrating an example of gray scale voltages determined in the liquid crystal display device.

In addition, in the first embodiment, if there is no variation in the gray scale voltages (that is, if a result of the determination in Step Sp4 is NO), it is configured that the image data Db having the same contents as the previous frame are again output through Step Sp10. However, as shown in FIG. 11, it may be configured that the gray scale voltages of the first and second fields in the previous frame (here, the X frame) are altered and a frame having the altered gray scale voltages is output as the current frame (here, (X+1) frame).

With such a configuration, since a variation period of the gray scale voltage applied to the pixel electrodes is reduced by half and the amount of charge and discharge per unit time in the liquid crystal capacitor 320 decreases, it is possible to suppress power consumption.

In the first embodiment, in a case where the gray scale value N specified by the image data Da in the frame to be processed is not the gray scale value corresponding to the outputtable voltage of the X driver 30, if the gray scale voltage is varied, two gray scale values specified in the image data Db are (N+1) and (N−1) independent of the amount of variation of the gray scale voltage. However, if the amount of variation is large, a difference between the two gray scale values may become large depending on the amount of variation. For example, for the gray scale value N specified by the image data Da in the frame to be processed, if the amount of variation of the gray scale voltage from the immediate previous frame is large, two gray scale values specified in the image data Db may be assumed as (N+3) and (N−3).

In addition, in a case where a difference between two gray scale values specified in the image data Db are varied depending on the amount of variation, there may be no difference between the two gray scale values depending on the gray scale values specified in the image data Da. For example, if the gray scale value specified by the image data Da of the frame to be processed is, for example, the gray scale value of 0 or 15 (minimum or maximum value), the gray scale value can not be (N+3) or (N−3). On this account, it may be determined whether or not the gray scale values specified by the image data Da correspond to the a minimum or maximum gray scale value.

In addition, in the first embodiment, it is determined in Step Sp4 whether or not the gray scale voltages are varied. However, even if there is any variation of gray scale voltages, such variation may be disregarded in some cases, for example, in a case where the gray scale values are minutely varied since mark polarities are identical to each other. On this account, when it is determined that the gray scale voltages are varied, if the amount of variation of the gray scale voltages exceeds a predetermined threshold, the process may proceed to Step Sp5.

Figure 12:
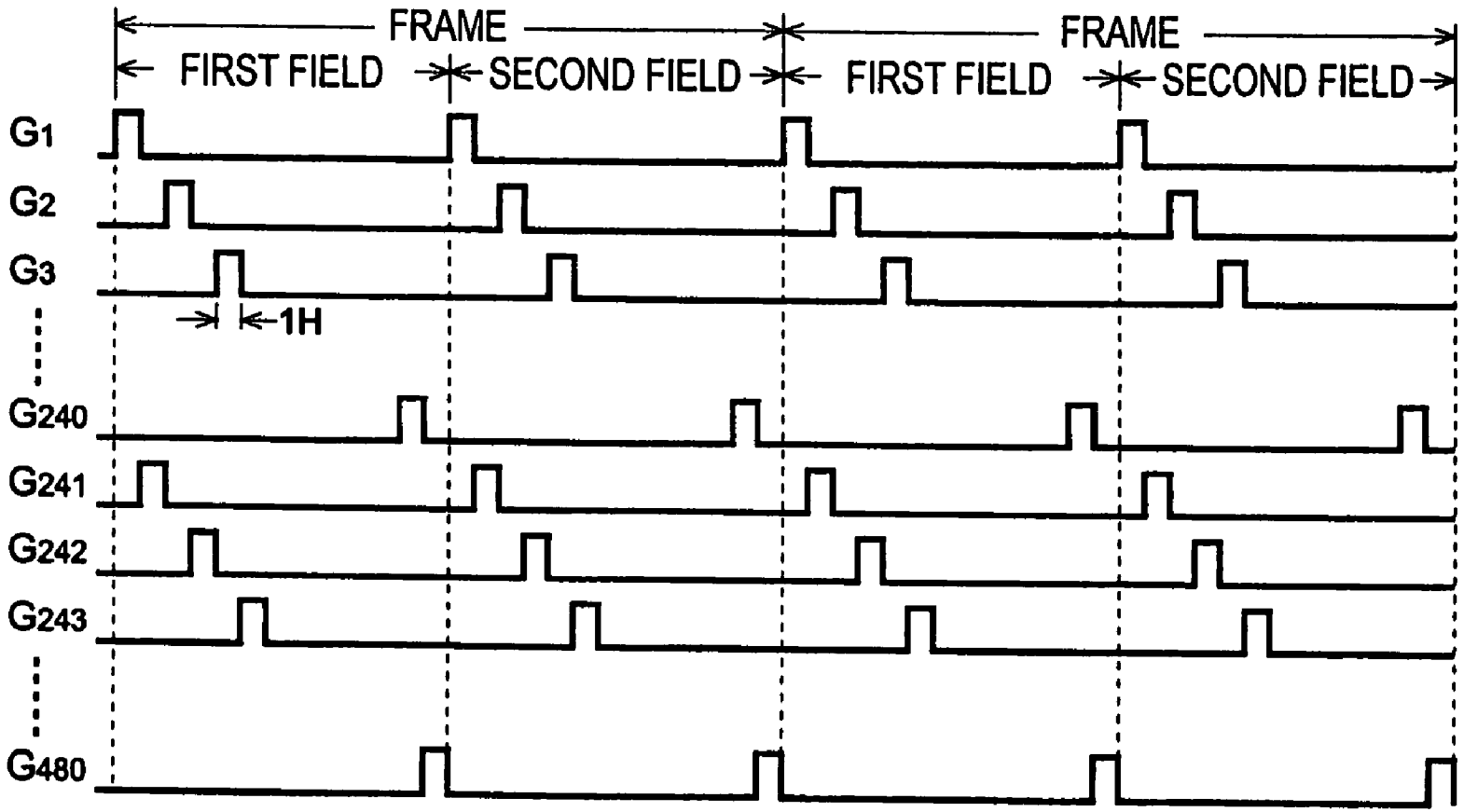
FIG. 12 is a view illustrating an example of voltage waveforms for scan lines in the liquid crystal display device.

In addition, in the first embodiment, the Y drivers 40*a* and 40*b* scan the scan lines in the order as shown in FIG. 3. However, as shown in FIG. 12, the Y drivers 40*a* and 40*b* may alternately scan the scan lines in the order of from the top to the bottom. That is, the scan lines may be scanned in the order of $G_1$, $G_{241}$, $G_2$, $G_{242}$, $G_3$, $G_{243}$, . . . , $G_{240}$, $G_{480}$ for the first field, and may be scanned in the same order for the second field.

In such a scan, when scan lines are selected on every other scan line, like the scan lines $G_1$, $G_2$, $G_3$, . . . , $G_{240}$ in the first field and the scan lines $G_{241}$, $G_{242}$, $G_{243}$, . . . , $G_{480}$, since that order becomes the scan lines $G_1 \rightarrow G_{480}$ for one frame, each of the Y drivers 40*a* and 40*b* may drive the scan lines at a conventional speed (a speed at which the scan lines $G_1$ to $G_{480}$ are scanned once during one frame).

Second Embodiment

In the above-described first embodiment, the voltage determining unit 18 obtains the image data Db for each pixel according to the process shown in FIG. 5 using the image data Da of the current frame and the image data Dd of the previous frame. That is, in the first embodiment, the image data Db is obtained from the image data Da and the image data Dd through a specific calculation.

However, the invention is not limited to the first embodiment. For example, it may be configured that a plurality of voltage patterns are set in advance, one voltage pattern is selected from the image data Da and the image data Dd, and the selected voltage pattern is output as the image data Db.

From the point of view of such a configuration, a second embodiment is to construct the voltage determining unit 18.

A liquid crystal display device according to the second embodiment is generally similar to that according to the first embodiment shown in FIG. 1, but is different in a detailed configuration of the data processing circuit 10 including the voltage determining unit 18 from the first embodiment. Therefore, the second embodiment will be described focusing on the difference in the data processing circuit 10.

Figure 13:
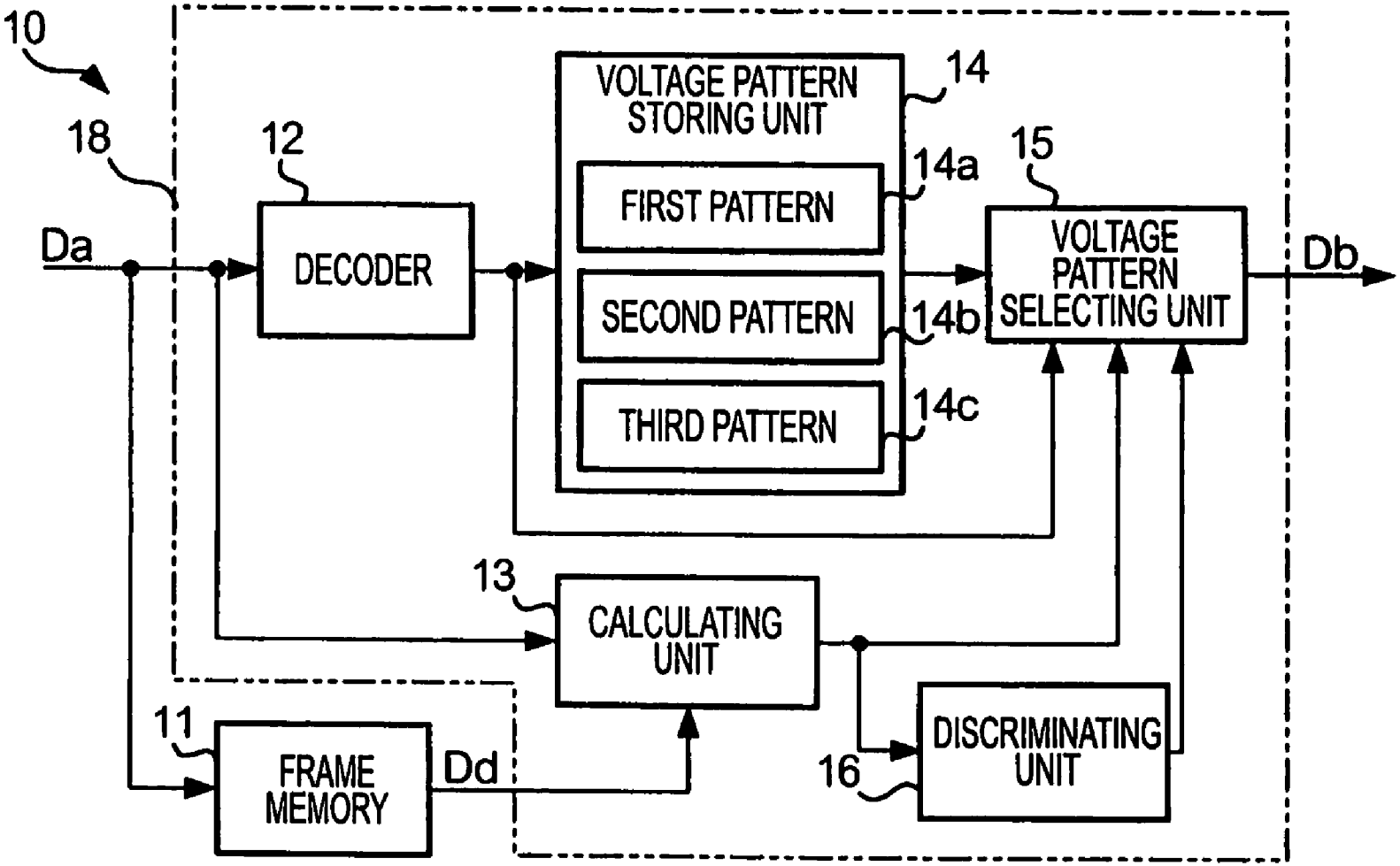
FIG. 13 is a view illustrating configuration of a data processing circuit according to a second embodiment of the invention.

FIG. 13 is a block diagram illustrating configuration of the data processing circuit 10 according to the second embodiment.

As shown in the figure, the data processing circuit 10 is similar to that shown in FIG. 4 in that it includes the frame memory 11 and the voltage determining unit 18. However, the voltage determining unit 18 of the second embodiment further includes a decoder 12, a calculating unit 13, a voltage pattern storing unit 14, a voltage pattern selecting unit 15, and a discriminating unit 16.

Of these components, the decoder 12 decodes the gray scale values specified in the image data Da of the current frame and the mark polarity and acquires the gray scale voltages specified in the image data Da.

On the other hand, the calculating unit 13 subtracts the gray scale voltages specified in the image data Dd of the previous frame from the gray scale voltages specified in the image data Da of the current frame, that is, a difference between the gray scale voltages over the range from the previous frame to the current frame, for the same pixel, and outputs a signal 152 representing the obtained difference.

Figure 14:
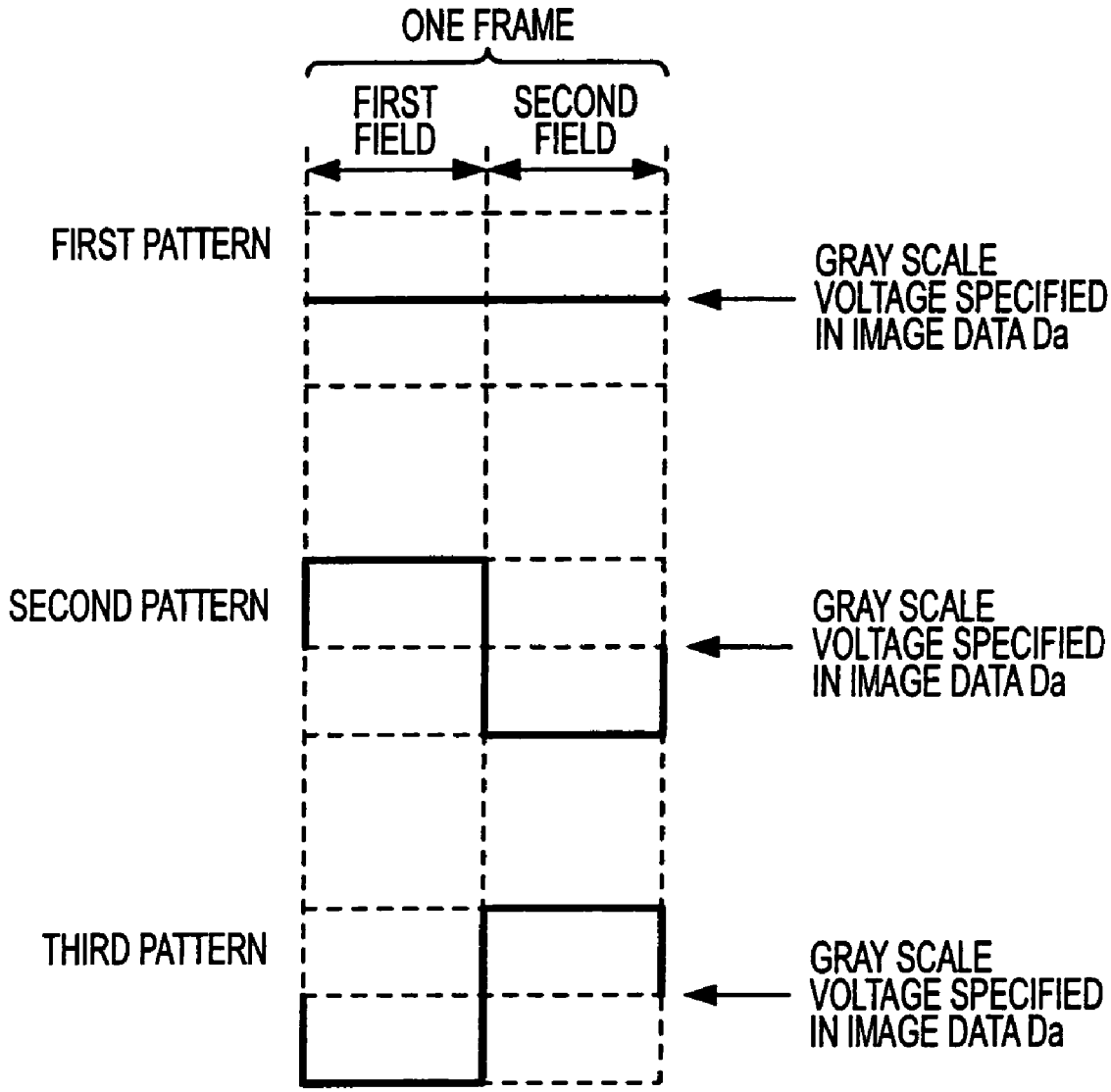
FIG. 14 is a view illustrating a voltage pattern stored in the data processing circuit.

The voltage pattern storing unit 14 stores three kinds of voltage patterns specifying the gray scale voltages in the first and second fields, more specifically, a first pattern 14*a*, a second pattern 14*b* and a third pattern 14*c*, as shown in FIG. 14.

Of these patterns, the first pattern 14*a* is a voltage pattern where the gray scale voltages specified in the image data Da are specified, as they are, for the first and second fields. That is, the first pattern 14*a* is a voltage pattern as specified in Step Sp9 in the first embodiment.

Next, the second pattern 14*b* is a voltage pattern where the gray scale voltages used in the first field are higher than the gray scale voltages specified in the image data Da and the gray scale voltages used in the second field are lower than the gray scale voltages specified in the image data Da. That is, the second pattern 14*b* is a voltage pattern as specified in Step Sp7 when the positive mark is specified (see FIG. 8A) and in Step Sp8 when the negative mark is specified (see FIG. 8B) in the first embodiment.

In addition, the third pattern 14*c* is a voltage pattern where the gray scale voltages used in the first field are lower than the gray scale voltages specified in the image data Da and the gray scale voltages used in the second field are higher than the gray scale voltages specified in the image data Da. That is, the third pattern 14*c* is a voltage pattern as specified in Step Sp8 when the positive mark is specified (see FIG. 9A) and in Step Sp7 when the negative mark is specified (see FIG. 9B) in the first embodiment.

In addition, the voltage pattern storing unit 14 sets an average value of the gray scale voltages of the first and second fields to be gray scale voltages decoded in the decoder 12, that is, the gray scale voltages specified in the image data Da, in the first pattern 14*a*, the second pattern 14*b* and the third pattern 14*c*. Accordingly, an average value of the gray scale voltages at any voltage pattern is equal to the gray scale voltages specified in the image data Da.

The discriminating unit 16 discriminates whether or not the difference between the gray scale voltages is 0 based on the signal 152. In addition, as described in the above first embodiment, even if there is any variation of gray scale voltages, there is a case where such variation may be disregarded. In this case, the discriminating unit 16 discriminates whether or not the difference between the gray scale voltages exceeds a predetermined threshold.

The voltage pattern selecting unit 15 selects one voltage pattern stored in the voltage pattern storing unit 14 based on the signal supplied from the calculating unit 13 and a result of the discrimination in the discriminating unit 16, and outputs the image data Db specified in the selected voltage pattern to the first and second fields.

More specifically, the voltage pattern selecting unit 15 selects the first pattern 14*a* when the gray scale voltages specified in the image data Da (the gray scale voltages decoded in the decoder 12) is the outputtable voltage of the X driver 30, and selects a voltage pattern as follows when the gray scale voltages specified in the image data Da is not the outputtable voltage of the X driver 30. That is, when the gray scale voltages specified in the image data Da is not the outputtable voltage of the X driver 30, the voltage pattern selecting unit 15 selects the second pattern 14*b* if it is discriminated in the discriminating unit 16 that the difference between the gray scale voltages is not 0 but positive (that is, the variation direction is the increasing direction), and selects the third pattern 14*c* if it is determined that the difference is negative (that is, the variation direction is the decreasing direction).

In addition, when the gray scale voltages decoded in the decoder 12 is not the outputtable voltage of the X driver 30, the voltage pattern selecting unit 15 again outputs a voltage pattern selected in the previous frame also in the current frame if it is discriminated in the discriminating unit 16 in which the difference between the gray scale voltages is 0. A voltage pattern determining unit is constituted by the voltage pattern storing unit 14 and the voltage pattern selecting unit 15.

Here, a voltage pattern selected in the voltage pattern selecting unit 15 will be considered.

A point that the first pattern 14*a* is selected when the gray scale voltages decoded in the decoder 12 is the outputtable voltage of the X driver 30 corresponds to the point that, in the first embodiment, the result of the determination in Step Sp3 is 'NO', and the gray scale values of the first and second fields for the image data Db are assumed as the gray scale value N specified in the image data Da in Step Sp9.

Next, a case where the difference between the gray scale voltages over the range from the previous frame to the current frame is positive when the gray scale voltages decoded in the decoder 12 is not the outputtable voltage of the X driver 30 corresponds to cases (1), (2) and (3) in the first embodiment.

In addition, a case where the difference between the gray scale voltages over the range from the previous frame to the current frame is negative when the gray scale voltages decoded in the decoder 12 is not the outputtable voltage of the X driver 30 corresponds to cases (4), (5) and (6) in the first embodiment.

In addition, a case where the difference between the gray scale voltages over the range from the previous frame to the current frame is 0 when the gray scale voltages decoded in the decoder 12 is not the outputtable voltage of the X driver 30 corresponds to the point that, in the first embodiment, the result of the determination in Step Sp3 is 'YES', the result of the determination in Step Sp4 is 'NO', and the same image data Db as the previous frame are output again in Step Sp10.

On this account, when the voltage pattern is selected in the voltage pattern selecting unit 15 in the second embodiment, the image data Db specified in the selected voltage pattern are exactly the same as the first embodiment. Accordingly, also in the second embodiment, it is possible to improve the responsiveness of the liquid crystal and increasing the number of representable gray scale levels.

Third Embodiment

In the first and second embodiments, it is configured that one frame is divided into the first and second fields and the mark of voltages to the pixels is performed twice per one frame, however, the present invention is not limited to this configuration. Now, a third embodiment in which one frame is divided into four fields will be described.

A liquid crystal display device according to the third embodiment is generally similar to that according to the first embodiment shown in FIG. 1, except that one frame is divided into four fields. For the sake of convenience, the four fields are referred to as first, second, third, and fourth fields in order from the earliest to the lasts in time.

Figure 15:
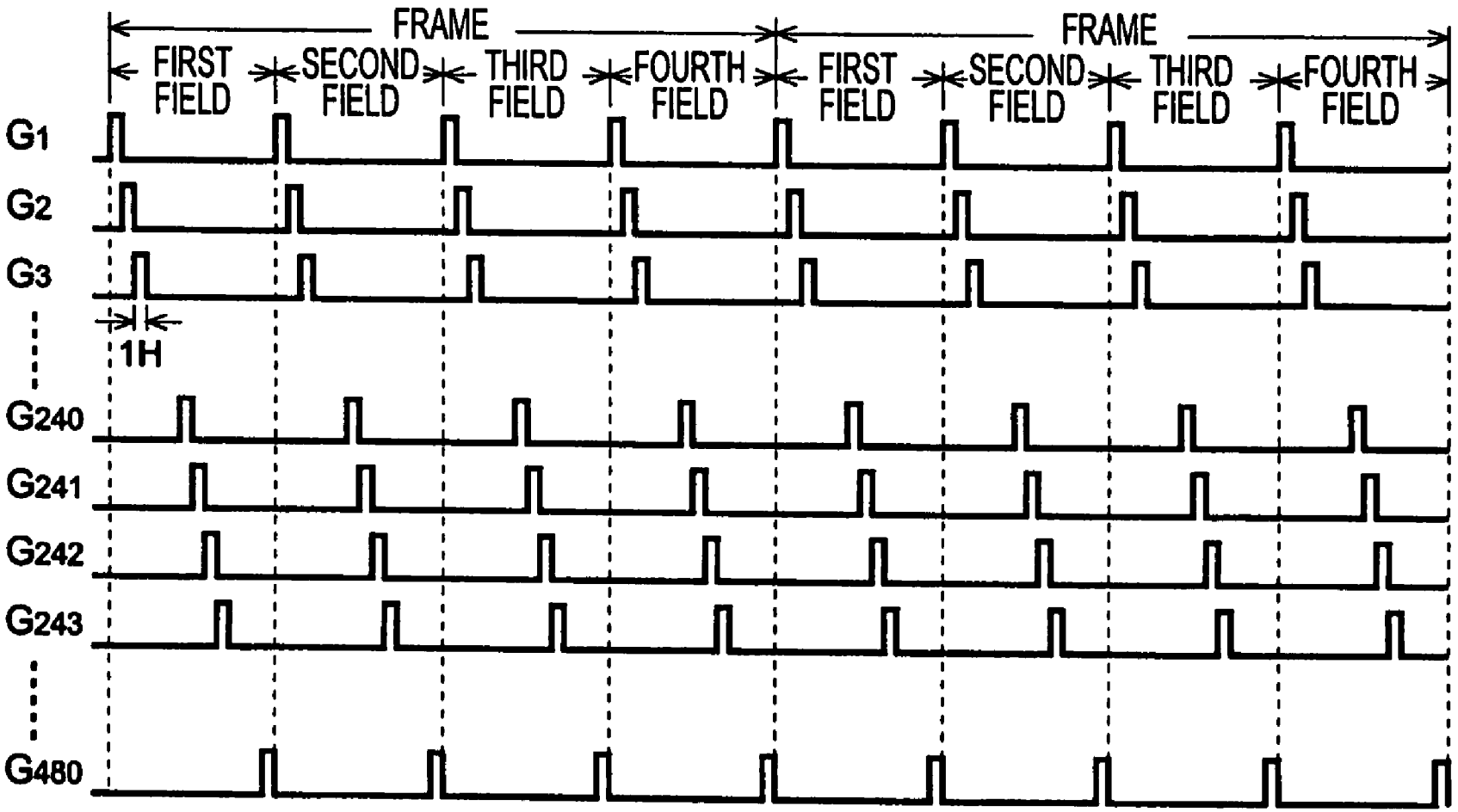
FIG. 15 is a view illustrating an example of voltage waveforms of scan lines in a liquid crystal display device according to a third embodiment of the present invention.

The timing control circuit 20 controls the Y drivers 40*a* and 40*b* to scan the scan lines in the order as shown in FIG. 15, for example. As a result, the scan lines G1, G2, . . . , G240 are scanned sequentially in the first half of the first field and the scan lines $G_{241}$, $G_{242}$, . . . , $G_{480}$ are scanned sequentially in the second half of the first field. The scan is also the same as the subsequent second, third and fourth fields. Accordingly, as a result, the scan lines are exclusively selected row-by-row in order from the top, and an H level signal is supplied to the selected scan lines. On this account, in this embodiment, a mark is performed four times for one frame in each pixel 300.

In addition, the third embodiment is similar to the first embodiment in that the X driver 30 converts the image data Db corresponding to one row of pixels located on the selected scan lines to an analog signal and supplies the analog signal to the signal line $S_1$, $S_2$, $S_3$, . . . , $S_{640}$.

In addition, the liquid crystal display device according to the third embodiment is different from the first and second embodiments in a relationship between the gray scale values corresponding to the voltages outputtable from the X driver 30 and the gray scale values represented pseudo gray scale values using the gray scale value corresponding to the voltages outputtable from the X driver 30.

Figure 16:
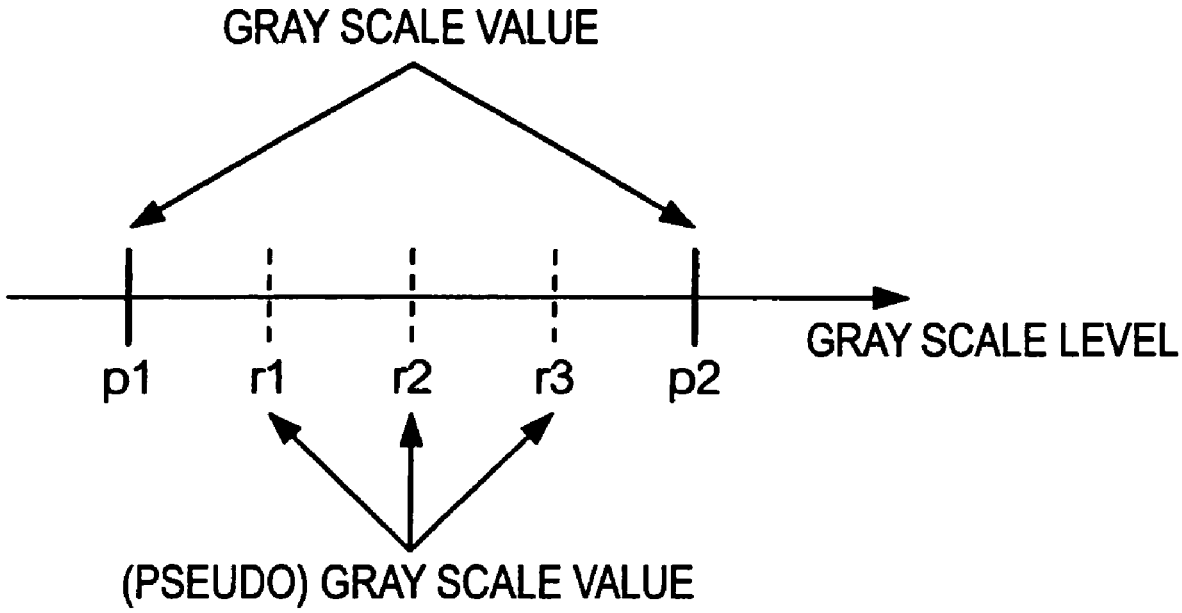
FIG. 16 is a view illustrating an example of a gray scale display in the liquid crystal display device.

Here, this relationship will be described with reference to FIG. 16. In FIG. 16, a horizontal axis denotes gray scale.

In this drawing, p1, r1, r2, r3 and p2 are adjacent gray scale values specified in the image data Da arranged at an equal interval. Of these gray scale values, the gray scale values p1 and p2 are gray scale values corresponding to the outputtable voltages of the X driver 30, but the gray scale values r1, r2, and r3 do not correspond to the outputtable voltages of the X driver 30.

In addition, here, only the gray scale values p1 and p2 of the gray scale values corresponding to the outputtable voltage of the X driver 30 are extracted.

On the other hand, the voltage determining unit 18 according to the third embodiment assumes the same configuration as the second embodiment, however, it is different from the third embodiment by a voltage pattern stored in the voltage pattern storing unit 14. Now, this voltage pattern will be described with reference to FIGS. 17A, 17B and 17C. In these drawings, a horizontal axis denotes time (field) and a vertical axis denotes a gray scale voltage.

Figure 17A:
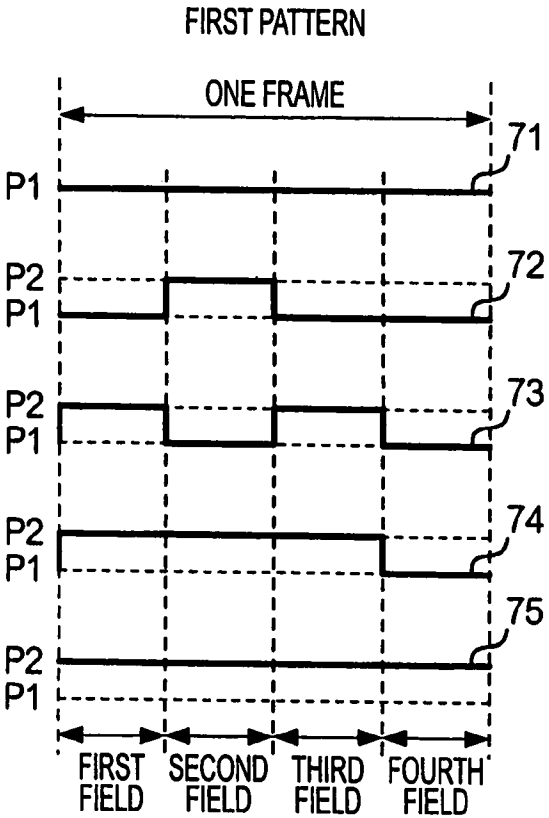
FIG. 17A is a view illustrating a voltage pattern used in the liquid crystal display device.
Figure 17B:
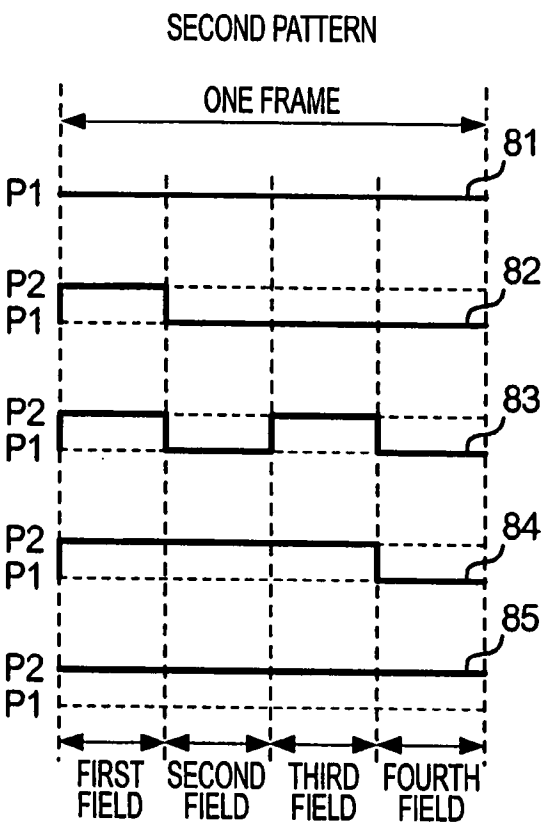
FIG. 17B is a view illustrating a voltage pattern used in the liquid crystal display device.
Figure 17C:
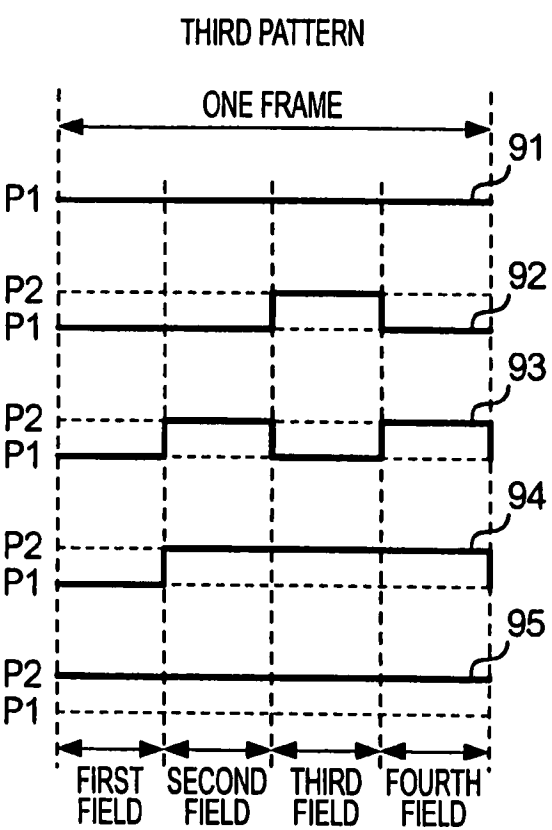
FIG. 17C is a view illustrating a voltage pattern used in the liquid crystal display device.

Here, FIG. 17A shows a first pattern (group), FIG. 17B shows a second pattern, and FIG. 17C shows a third pattern. These voltage patterns are stored in advance in the voltage pattern storing unit 14.

Here, the first pattern corresponds to a case where the gray scale voltages are not varied over the range from the previous frame to the current frame, and are divided into five voltage patterns 71 to 75. These voltage patterns 71 to 75 correspond to the gray scale values p1, r1, r2, r3, and p2, respectively.

The second pattern corresponds to a case where the gray scale voltages increase over the range from the previous frame to the current frame, and are divided into five voltage patterns 81 to 85. These voltage patterns 81 to 85 correspond to the gray scale values p1, r1, r2, r3, and p2, respectively.

The third pattern corresponds to a case where the gray scale voltages decrease over the range from the previous frame to the current frame, and are divided into five voltage patterns 91 to 95. These voltage patterns 91 to 95 correspond to the gray scale values p1, r1, r2, r3, and p2, respectively.

In the third embodiment, if it is discriminated in the discriminating unit 16 in which the difference between the gray scale voltages over the range from the previous frame to the current frame is 0, the voltage pattern selecting unit 15 in the data processing circuit 10 selects a voltage, which corresponds to the gray scale values specified in the image data Da, of the first pattern. In addition, if it is discriminated in the discriminating unit 16 that the difference between the gray scale voltages is not 0, the voltage pattern selecting unit 15 selects a voltage, which corresponds to the gray scale values specified in the image data Da, of the second pattern if the difference is positive (that is, the variation direction is the increasing direction) and selects a voltage, which corresponds to the gray scale values specified in the image data Da, of the third pattern if the difference is negative (that is, the variation direction is the decreasing direction).

In FIGS. 17A, 17B and 17C, gray scale voltages P1 and P2 are voltages corresponding to the gray scale values p1 and p2, respectively, considering the mark polarity, with a relationship of P1<P2.

Here, when a bright state is designated as the gray scale values increase in the normally white mode, the gray scale voltage relationship of P1<P2 is established when the gray scale values p1>p2 if a positive mark is designated and when the gray scale values p1<p2 if a negative mark is designated. In this manner, since the magnitude relationship of the gray scale voltages P1 and P2 for the two gray scale values p1 and p2 is reversed by the mark polarity, the gray scale values shown in FIG. 16 have a relationship of p1>r1>r2>r3>p2 when the positive mark is designated and a relationship of p1<r1<r2<r3<p2 when the negative mark is designated.

Also in consideration, the voltage patterns 71, 81 and 91 represent patterns of the gray scale voltages used when the gray scale value p1 is represented. More specifically, if a gray scale value specified in the image data Da is p1, the gray scale value p1 and the gray scale voltage P1 specified by the mark polarity are predetermined through the first to fourth fields.

In addition, the voltage patterns 71, 81 and 91 are the same. Accordingly, when any one of the first, second and third patterns is selected in the voltage pattern selecting unit 15 (that is, regardless of the variation of the gray scale voltages from the previous frame when the gray scale values specified in the image data Da of the current frame), the voltage patterns 71, the selected pattern has apparently the same pattern 71 (81, 91).

Next, the voltage patterns 72, 82 and 92 represent patterns of the gray scale voltages used when the gray scale value r1 is represented.

The voltage pattern 72 belonging to the first pattern becomes the gray scale voltage P1 corresponding to the gray scale value p1 close to the gray scale value r1 in the first, third and fourth fields and becomes the gray scale voltage P2 corresponding to the gray scale value p2 distant from the gray scale value r1 in the second field.

The voltage pattern 82 belonging to the second pattern becomes the gray scale voltage P1 in the second, third and fourth fields and becomes the gray scale voltage P2 in the first field. As described above, since the second pattern is selected when the gray scale voltages specified in the image data Da over the range from the previous frame to the current frame increase, the gray scale voltage P2 shifted in the increasing direction as the variation direction is applied to the pixel electrode (in the first field) prior to a voltage corresponding to the gray scale value r1, and thereafter, the gray scale voltage P1 shifted in the decreasing direction opposite to the variation direction is applied to the pixel electrode (after the first second) prior to the voltage corresponding to the gray scale value r1.

The voltage pattern 92 belonging to the third pattern becomes the gray scale voltage P1 in the first, second and fourth fields and becomes the gray scale voltage P2 in the third field. As described above, since the third pattern is selected when the gray scale voltages specified in the image data Da over the range from the previous frame to the current frame decrease, the gray scale voltage P1 shifted in the decreasing direction as a variation direction is applied to the pixel electrode (in the first and second fields) prior to the voltage corresponding to the gray scale value r1, and thereafter, the gray scale voltage P2 shifted in the increasing direction opposite to the variation direction is applied to the pixel electrode (in the third field) prior to the voltage corresponding to the gray scale value r1, and the gray scale voltage P1 is again applied to the pixel electrode (in the fourth field).

Subsequently, the voltage patterns 73, 83 and 93 represent patterns of the gray scale voltages used when the gray scale value r2 is represented.

The voltage pattern 73 belonging to the first pattern and the voltage pattern 83 belonging to the second pattern becomes the gray scale voltage P1 in the second and fourth fields and becomes the gray scale voltage P2 in the first and third fields. Since the voltage pattern 83 of these voltage patterns considers a case where the gray scale voltages specified in the image data Da increase, the gray scale voltage P2 shifted in the increasing direction as the variation direction is applied to the pixel electrode (in the first field) prior to a voltage corresponding to the gray scale value r2, and thereafter, the gray scale voltage P1 shifted in the decreasing direction opposite to the variation direction is applied to the pixel electrode (in the second field).

The voltage pattern 93 belonging to the third pattern becomes the gray scale voltage P1 in the first and third fields and becomes the gray scale voltage P2 in the second and fourth fields. Since the voltage pattern 93 considers a case where the gray scale voltages specified in the image data Da decrease, the gray scale voltage P1 shifted in the decreasing direction as the variation direction is applied to the pixel electrode (in the first field) prior to the voltage corresponding to the gray scale value r2, and thereafter, the gray scale voltage P2 shifted in the increasing direction opposite to the variation direction is applied to the pixel electrode (in the second field).

The voltage patterns 74, 84 and 94 represent patterns of the gray scale voltages used when the gray scale value r3 is represented.

The voltage pattern 74 belonging to the first pattern and the voltage pattern 84 belonging to the second pattern become the gray scale voltage P2 corresponding to the gray scale value p2 close to the gray scale value r3 in the first, second and third fields and become the gray scale voltage P1 corresponding to the gray scale value p1 distant from the gray scale value r3 in the fourth field. Since the voltage pattern 84 of these voltage patterns considers a case where the gray scale voltages specified in the image data Da increase, the gray scale voltage P2 shifted in the increasing direction as the variation direction is applied to the pixel electrode (in the first, second and third fields) prior to a voltage corresponding to the gray scale value r3, and thereafter, the gray scale voltage P1 shifted in the decreasing direction opposite to the variation direction is applied to the pixel electrode (in the second field) prior to the voltage corresponding to the gray scale value r1.

The voltage pattern 94 belonging to the third pattern becomes the gray scale voltage P1 in the first field and becomes the gray scale voltage P2 in the second, third and fourth fields. Since the voltage pattern 94 considers a case where the gray scale voltages specified in the image data Da decrease, the gray scale voltage P1 shifted in the decreasing direction as the variation direction is applied to the pixel electrode (in the first field) prior to the voltage corresponding to the gray scale value r3, and thereafter, the gray scale voltage P2 shifted in the increasing direction opposite to the variation direction is applied to the pixel electrode (after the second field) prior to the voltage corresponding to the gray scale value r3.

The voltage patterns 75, 85 and 95 represent patterns of the gray scale voltages used when the gray scale value p2 is represented. More specifically, if a gray scale value specified in the image data Da is p2, the gray scale value p2 and the gray scale voltage P2 specified by the mark polarity are predetermined through the first to fourth fields.

Next, in the third embodiment, marks obtainable when the gray scale values or mark polarities of the pixels are varied from the immediate previous frame will be considered.

Figure 18A:
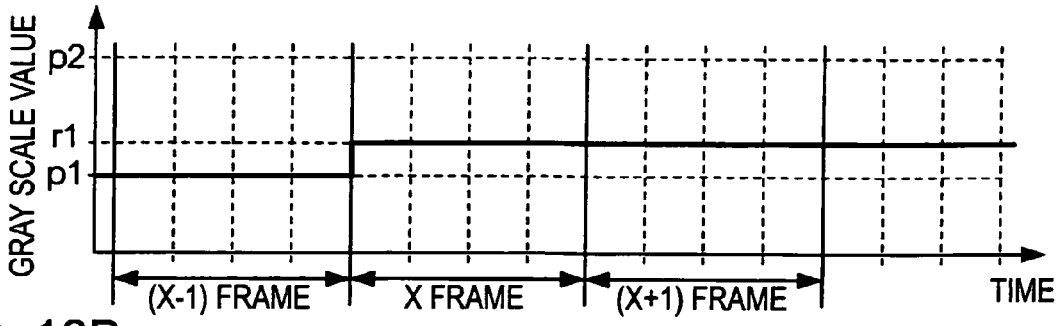
FIG. 18A is a view illustrating variations of a gray scale value and a gray scale voltage in the liquid crystal display device.

FIG. 18A is a view illustrating variation of the gray scale values specified in the image data Da of one pixel to be considered. In this drawing, a horizontal axis denotes time and a vertical axis denotes a gray scale value.

As shown in this drawing, the image data Da is input in order of an (X−1) frame, an X frame and an (X+1) frame. More specifically, the gray scale value p1 is specified in the (X−1) frame and the gray scale value r1 is specified in the X frame and the (X+1) frame. Accordingly, the gray scale value is varied from the gray scale value p1 to the gray scale value r1 over a range from the (X−1) frame to the X frame. In addition, a negative polarity is designated through the (X−1) frame, the X frame and the (X+1) frame.

Figure 18B:
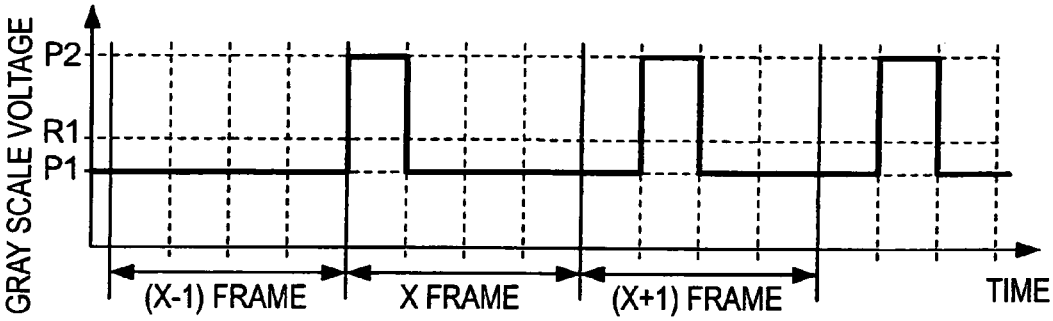
FIG. 18B is a view illustrating variations of a gray scale voltage and a gray scale voltage in the liquid crystal display device.

FIG. 18B shows the gray scale voltages specified in the image data Db output from the data processing circuit 10 (the voltage determining unit 18), that is, a voltage applied to the pixel electrode of a pixel to be considered, when the gray scale values specified in the image data Da are varied as shown in FIG. 18A. In this drawing, a horizontal axis denotes time and a vertical axis denotes a gray scale voltage.

By the way, when a gray scale value specified in the image data Da in the (X−1) frame is p1, a gray scale voltage in the (X−1) frame becomes P1 corresponding to the gray scale value p1, regardless of variation of the gray scale voltages from the previous (X−2) frame (not shown), as described above.

The gray scale value r1 specified in the image data Da in the X frame does not correspond to the outputtable voltages of the X driver 30. In addition, the gray scale value is varied from the gray scale value p1 of the previous (X−1) frame to the gray scale value r1. Here, since the negative polarity is designated, a relationship of p1<r1 is established, and the gray scale voltages specified in the image data Da increase over the range from the (X−1) frame to the X frame and a difference between the gray scale voltages is positive. On this account, the voltage pattern selecting unit 15 selects the voltage pattern 82 belonging to the second pattern and corresponding to the gray scale value r1. Accordingly, the image data Db corresponding to the pixel become the gray scale voltage P2 in the first field of the X frame and the gray scale voltage P1 in the subsequent second, third and fourth fields.

When the gray scale voltages are increased in the X frame, since the gray scale voltage P2 shifted in the increasing direction in the first field is marked to the liquid crystal capacitor of the pixel prior to the voltage corresponding to the gray scale value p1 specified in the image data Da, it is possible to improve the responsiveness of the liquid crystal 305 having a relatively low response speed. In addition, the gray scale value r1 is located on a point at which a distance between the gray scale value p1 and the gray scale value p2 is divided internally with a ratio of 1:3, and the gray scale voltage P1 corresponding to the gray scale value p1 is applied to the pixel electrode over the sum of three fields of the second, third and fourth fields, while the gray scale voltage P2 corresponding to the gray scale value p2 is applied to the pixel electrode only during the first field. Accordingly, the gray scale levels are almost represented as the pseudo values when one frame is viewed.

Even though the gray scale value r1 specified in the image data Da in the (X+1) frame does not correspond to the outputtable voltages of the X driver 30, the gray scale value is not varied from the gray scale value r1 of the previous X frame. On this account, the voltage pattern selecting unit 15 selects the voltage pattern 72 belonging to the first pattern and corresponding to the gray scale value r1. Accordingly, the image data Db corresponding to the pixel to be considered becomes the gray scale voltage P1 in the first field of the (X+1) frame, the gray scale voltage P2 in the subsequent second field, and again the gray scale voltage P1 in the subsequent third and fourth fields.

When corresponding scan lines in each field of one frame are selected, the image data Db corresponding to the field are converted to an analog signal by the x driver 30 and the analog signal is applied to corresponding signal lines. Accordingly, the gray scale voltages specified in the image data Db are applied to the pixel electrode.

The pseudo gray scale value of the gray scale value r1 in the (X−1) frame is similar to the previous X frame.

In this example, the case where the gray scale voltages specified in the image data Da increase has been described. Now, a case where the gray scale voltages specified in the image data Da decrease will be considered.

Figure 19A:
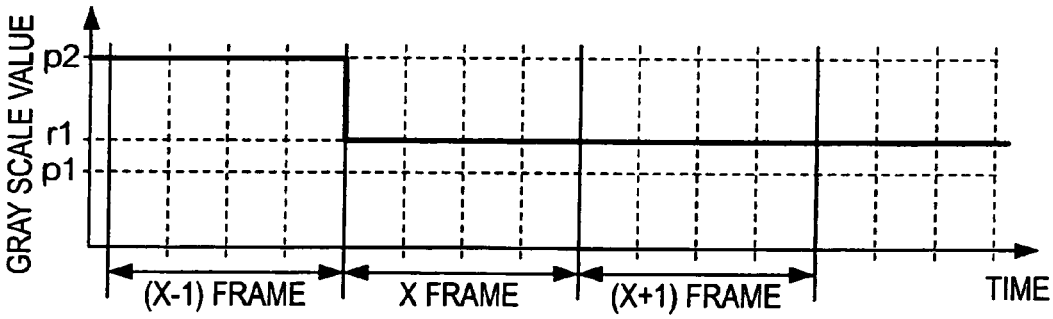
FIG. 19A is a view illustrating variations of a gray scale value and a gray scale voltage in the liquid crystal display device.

FIG. 19A is a view illustrating variation of the gray scale values specified in the image data Da of one pixel to be considered. In this drawing, a horizontal axis denotes time and a vertical axis denotes a gray scale value.

As shown in this drawing, the gray scale value p2 is specified in the (X−1) frame and the gray scale value r1 is specified in the X frame and the (X+1) frame. Accordingly, the gray scale value is varied from the gray scale value p2 to the gray scale value r1 over the range from the (X−1) frame to the X frame. In addition, a negative polarity is designated through the (X−1) frame, the X frame and the (X+1) frame.

Figure 19B:
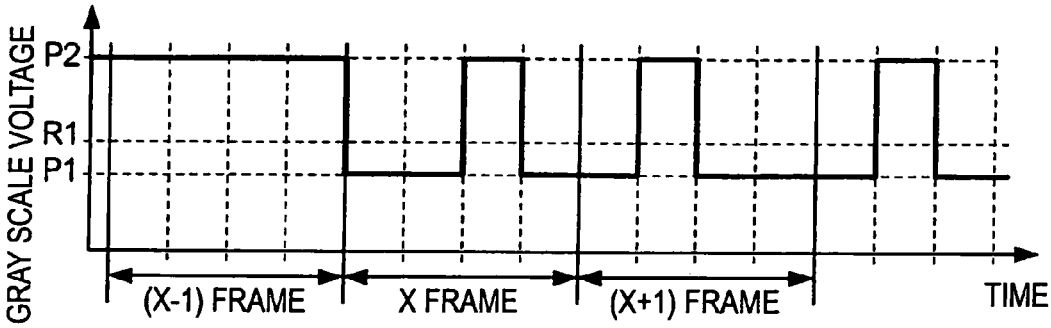
FIG. 19B is a view illustrating variations of a gray scale voltage and a gray scale voltage in the liquid crystal display device.

FIG. 19B shows the gray scale voltages specified in the image data Db output from the data processing circuit 10 (the voltage determining unit 18) and applied to the pixel electrode of the pixel to be considered, based on the above-mentioned condition setting.

By the way, when a gray scale value specified in the image data Da is p2 in the (X−1) frame, a gray scale voltage in the (X−1) frame becomes P2 corresponding to the gray scale value p2, regardless of variation of the gray scale voltages from the previous (X−2) frame (not shown).

In the X frame, the gray scale value is varied from the gray scale value p2 of the previous (X−1) frame to the gray scale value r1. Here, since the negative polarity is designated, a relationship of r1<p2 is established, and the gray scale voltages specified in the image data Da decreases over the range from the (X−1) frame to the X frame and a difference between the gray scale voltages is negative. On this account, the voltage pattern selecting unit 15 selects the voltage pattern 92 belonging to the third pattern and corresponding to the gray scale value r1. Accordingly, the image data Db corresponding to the pixel becomes the gray scale voltage P1 in the first and second fields of the x frame, the gray scale voltage P2 in the subsequent third field, and again the gray scale voltage P1 in the fourth field.

When the gray scale voltages are decreased in the X frame, since the gray scale voltage P1 shifted in the decreasing direction in the first and second fields is marked to the liquid crystal capacitor of the pixel prior to a voltage corresponding to the gray scale value r1 specified in the image data Da, it is possible to improve the responsiveness of the liquid crystal 305 having a relatively low response speed. In addition, the gray scale value r1 is located on a point at which a distance between the gray scale value p1 and the gray scale value p2 is divided internally with a ratio of 1:3, and the gray scale voltage P1 corresponding to the gray scale value p1 is applied to the pixel electrode over the sum of three fields of the first, second, and fourth fields, while the gray scale voltage P2 corresponding to the gray scale value p2 is applied to the pixel electrode only during the third field. Accordingly, desired pseudo gray scale levels are almost represented when one frame is viewed.

The gray scale value r1 of the (X+1) frame is not varied from the previous x frame. On this account, the voltage pattern selecting unit 15 selects the voltage pattern 72 belonging to the first pattern and corresponding to the gray scale value r1. Operation at this time is similar to the above-described operation (FIG. 18B).

As described above, in the third embodiment, if the gray scale values specified in the image data Da of the current frame do not correspond to the outputtable voltage of the X driver 30, when the gray scale values specified in the image data Da are varied to become higher than the gray scale voltages of the previous frame, the gray scale voltages shifted in the increasing direction to become higher than the gray scale voltages specified in the image data Da are controlled to be applied to the preceding first field. If the gray scale values specified in the image data Da of the current frame do not correspond to the outputtable voltage of the X driver 30, when the gray scale values specified in the image data Da are varied to become lower than the gray scale voltages of the previous frame, the gray scale voltages shifted in the decreasing direction to become lower than the gray scale voltages specified in the image data Da are controlled to be applied to the preceding first field.

Accordingly, according to the third embodiment, display characteristics of the liquid crystal display panel 50 can be improved and a response speed thereof can be increased.

In addition, in the third embodiment, since the liquid crystal display panel 50 is driven with one frame divided into four fields, it is possible to further improve the ability to represent halftones.

In the third embodiment, the case where gray scale levels of the gray scale values r1 are represented is described. However, the same control may also be applied to a case where gray scale levels of the gray scale values r2 and r3 are represented. More specifically, when the gray scale levels of the gray scale value r2 (or r3) represented in the current frame, a voltage, which corresponds to the gray scale value r2 (or r3), of the second voltage pattern is used when the gray scale value r2 (or r3) is varied to become increased from the gray scale voltage of the previous frame, while a voltage, which corresponds to the gray scale value r2 (or r3), of the third voltage pattern is used when the gray scale value r2 (or r3) is varied to become decreased from the gray scale voltage of the previous frame.

In addition, in the third embodiment, it is configured that one of the second and third patterns is selected if the difference between the gray scale voltages over the range from the previous frame to the current frame. However, it may be configured that the first pattern is selected if an absolute value of the difference is smaller than the predetermined threshold, and one of the second and third patterns is selected depending on a polarity (+ or −) if the absolute value of the difference exceeds the predetermined threshold.

Figure 20:
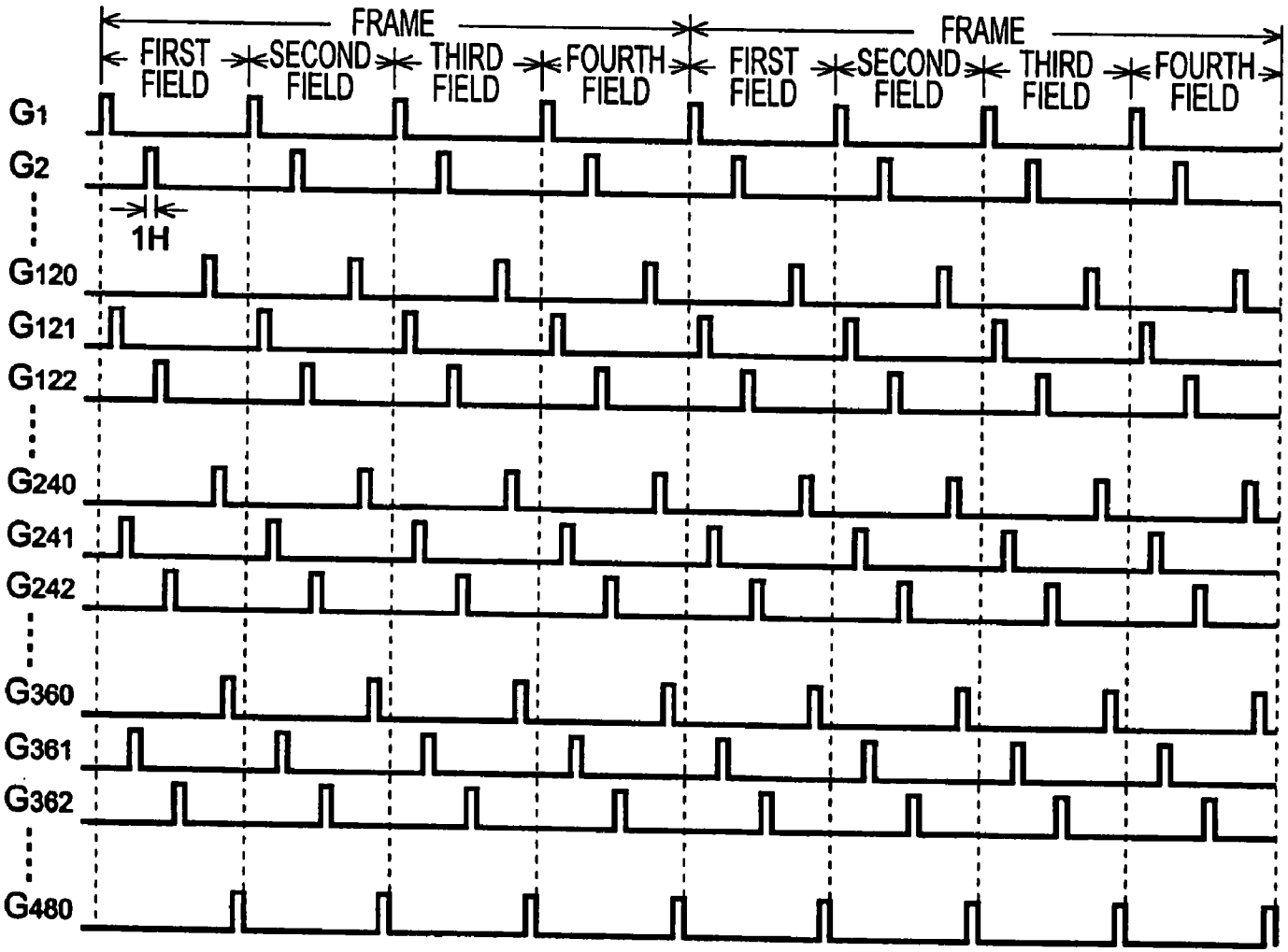
FIG. 20 is a view illustrating an example of voltage waveforms for scan lines in the liquid crystal display device.

In addition, in the third embodiment, when one frame is divided into four fields, the scan lines are selected in order as shown in FIG. 15. However, as shown in FIG. 12, the scan lines may be selected in order as shown in FIG. 20.

Fourth Embodiment

In the first, second and third embodiments, it is configured that the image data Db (voltage patterns) is generated (selected) to make voltages to be applied to each fields different only when the gray scale values specified in the image data Da of the current frame do not correspond to the outputtable voltages of the X driver 30. However, in a fourth embodiment, it is configured that, even when the gray scale values specified in the image data Da of the current frame correspond to the outputtable voltages of the x driver 30, a voltage pattern having different voltages of each field is selected depending on variation of the gray scale voltages over the range from the previous frame to the current frame.

More specifically, in the fourth embodiment, one frame is divided into two fields, for example, like the second embodiment, and the voltage pattern selecting unit 15 in the data processing circuit 10 selects the first pattern if the difference between the gray scale voltages over the range from the previous frame to the current frame is 0, selects the second pattern if the difference is positive (that is, the variation direction is the increasing direction), and selects the third pattern if the difference is negative (that is, the variation direction is the decreasing direction), as shown in FIG. 14.

Next, in the fourth embodiment, marks obtainable when the gray scale values or mark polarities of the pixels are varied from an immediate previous frame will be considered.

Figure 21A:
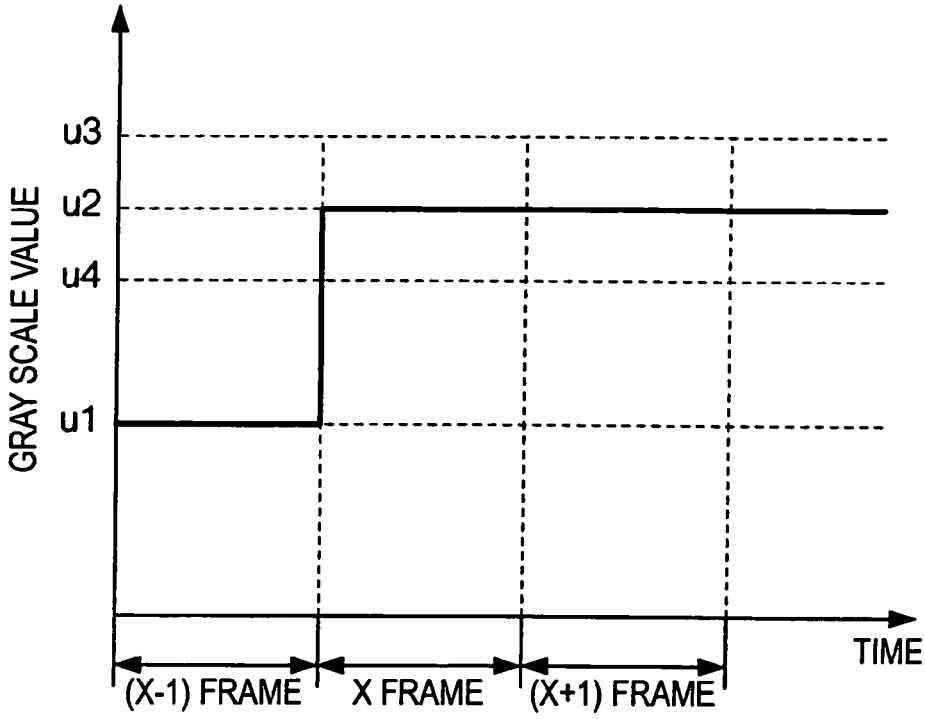
FIG. 21A is a view illustrating variations of a gray scale value in a liquid crystal display device according to a fourth embodiment of the present invention.

FIG. 21A is a view illustrating variation of the gray scale values specified in the image data Da of one pixel to be considered. In this drawing, a horizontal axis denotes time and a vertical axis denotes a gray scale value.

As shown in this drawing, the image data Da are input in order of an (X−1) frame, an X frame and an (X+1) frame. More specifically, the gray scale value u1 is specified in the (X−1) frame and the gray scale value u2 is specified in the X frame and the (X+1) frame. That is, the gray scale value is varied from the gray scale value u1 to the gray scale value u2 over a range from the (X−1) frame to the X frame, and the gray scale value u2 is predetermined over a range from the X frame to the (X+1) frame.

In addition, both of the gray scale values u1 and u2 are gray scale values corresponding to the outputtable voltages of the X driver 30. In addition, a negative polarity is designated through the (X−1) frame, the x frame and the (X+1) frame.

Figure 21B:
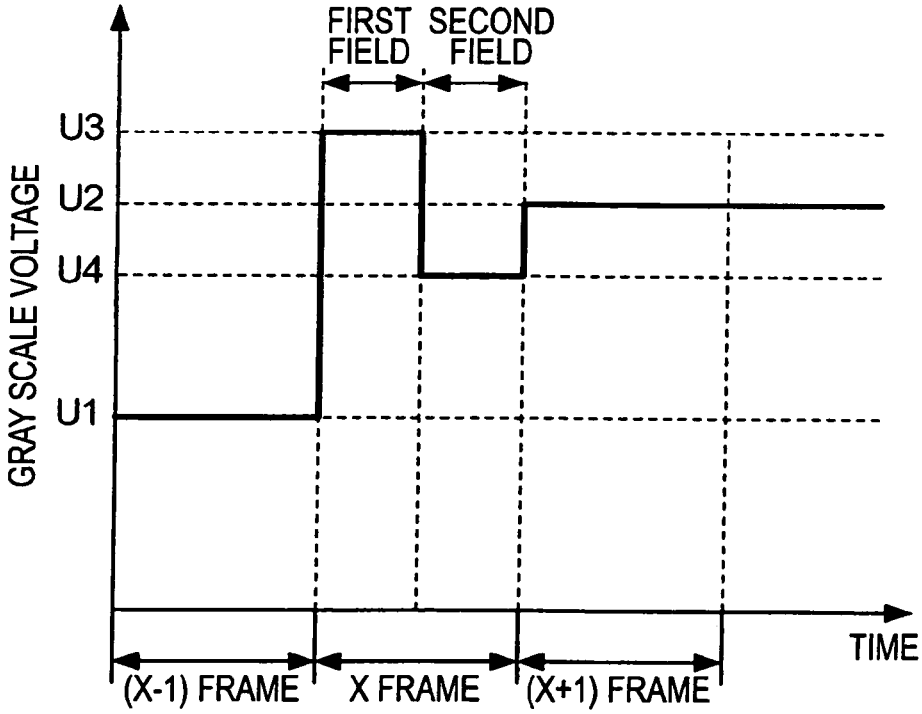
FIG. 21B is a view illustrating variations of a gray scale voltage in a liquid crystal display device according to a fourth embodiment of the present invention.

FIG. 21B shows the gray scale voltages specified in the image data Db output from the data processing circuit 10 (the voltage determining unit 18), that is, a voltage applied to the pixel electrode of the pixel to be considered, when the gray scale values specified in the image data Da are varied as shown in FIG. 21A. In this drawing, a horizontal axis denotes time and a vertical axis denotes a gray scale voltage.

When a gray scale value specified in the image data Da in the (X−1) frame is u1, if there is no variation of the gray scale voltages from the previous (X−2) frame (not shown), since the first pattern is selected in the (X−1) frame, a gray scale voltage in the (X−1) frame becomes U1 corresponding to the gray scale value u1 over a range from the first field to the third field.

The gray scale value u2 specified in the image data Da in the X frame is increasing from the gray scale value u1 of the previous (X−1) frame. Here, since the negative polarity is designated, a relationship of u1<u2 is established. On the account, since the gray scale voltages specified in the image data Da increase over the range from the (X−1) frame to the X frame and a difference between the gray scale voltages is positive, the voltage pattern selecting unit 15 selects the second pattern. Accordingly, the image data Db corresponding to the pixel becomes a gray scale voltage U3 shifted in a voltage increasing direction, rather than a gray scale voltage U2 corresponding to the gray scale value u2, in the first field of the X frame and a gray scale voltage U4 shifted in a voltage decreasing direction opposite to the voltage increasing direction, rather than the gray scale voltage U2, in the subsequent second field.

In addition, the gray scale voltages U3 and U4 are gray scale voltages corresponding to adjacent gray scale values of the gray scale value u2, for example, and have a relationship with the gray scale voltage U2 corresponding to the gray scale value u2, that is, an equation of U3>U2>U4.

The (X+1) frame has the same gray scale value u2 as the X frame, and has the same gray scale voltage as the X frame since both frames have the negative polarity, as described above.

On this account, since the voltage pattern selecting unit 15 selects the first pattern in the (X+1) frame, the image data Db specifies the gray scale voltage U2 corresponding to the gray scale value u2 in the first and second fields.

When corresponding scan lines in each field of one frame are selected, the image data Db corresponding to the field is converted to an analog signal by the X driver 30 and the analog signal is applied to corresponding signal lines. Accordingly, the gray scale voltages specified in the image data Db are applied to the pixel electrode.

In this example, the case where the gray scale voltages specified in the image data Da increase has been described. Now, a case where the gray scale voltages specified in the image data Da decrease will be considered.

Figure 22A:
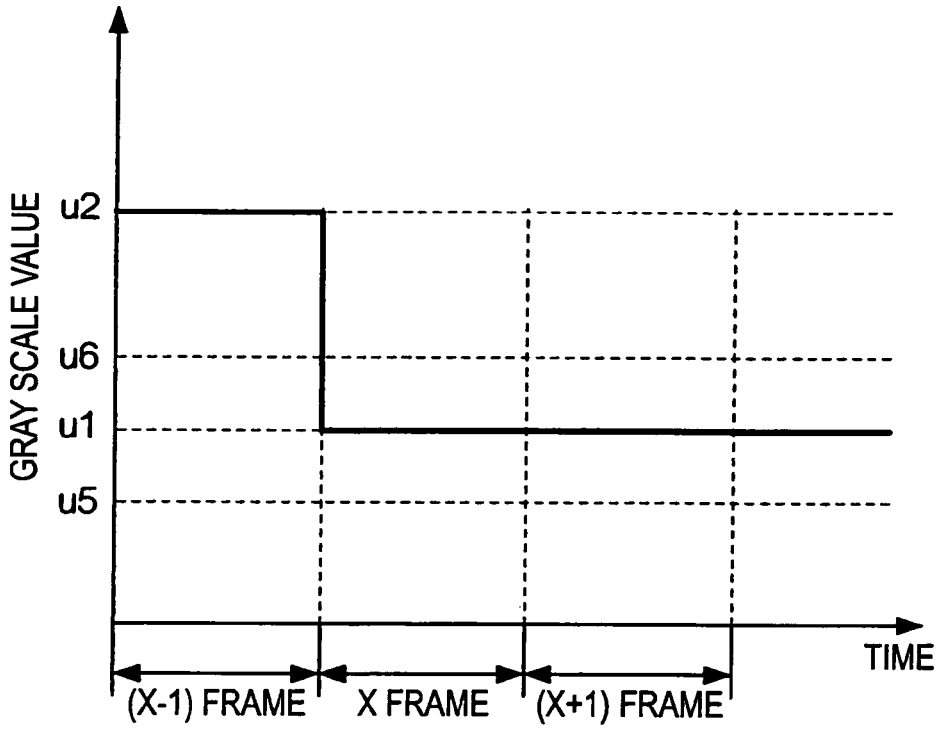
FIG. 22A is a view illustrating variations of a gray scale value in the liquid crystal display device.

FIG. 22A is a view illustrating variation of the gray scale values specified in the image data Da of one pixel to be considered. In this drawing, a horizontal axis denotes time and a vertical axis denotes a gray scale value.

As shown in this drawing, the image data Da are input in order of the (X−1) frame, the X frame and the (X+1) frame. More specifically, the gray scale value u2 is specified in the (X−1) frame and the gray scale value u1 is specified in the X frame and the (X+1) frame. That is, the gray scale value is varied from the gray scale value u2 to the gray scale value u1 over the range from the (X−1) frame to the X frame, and the gray scale value u1 is predetermined over the range from the X frame to the (X+1) frame.

In addition, as described above, both of the gray scale values u1 and u2 are gray scale values corresponding to the outputtable voltages of the X driver 30. In addition, the negative polarity is designated through the (X−1) frame, the X frame and the (X+1) frame.

Figure 22B:
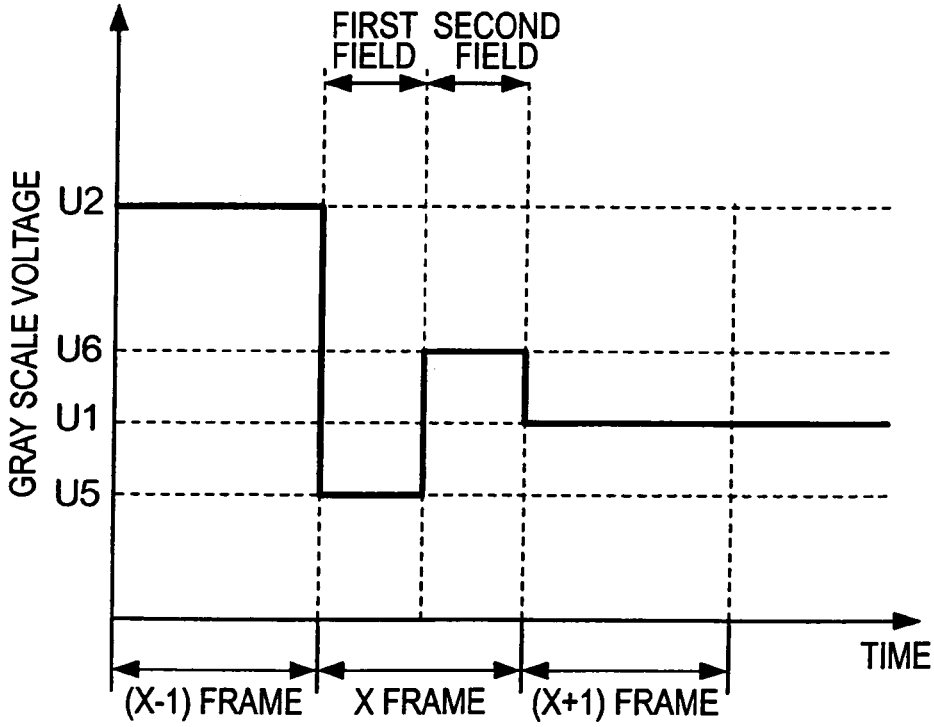
FIG. 22B is a view illustrating variations of a gray scale voltage in the liquid crystal display device.

FIG. 22B shows the gray scale voltages specified in the image data Db output from the data processing circuit 10 (the voltage determining unit 18), that is, a voltage applied to the pixel electrode of the pixel to be considered, when the gray scale values specified in the image data Da are varied as shown in FIG. 22A. In this drawing, a horizontal axis denotes time and a vertical axis denotes a gray scale voltage.

When a gray scale value specified in the image data Da in the (X−1) frame is u2, if there is no variation of the gray scale voltages from the previous (X−2) frame (not shown), since the first pattern is selected in the (X−1) frame, a gray scale voltage in the (X−1) frame becomes U2 corresponding to the gray scale value u2 over the range from the first field to the third field.

The gray scale value u1 specified in the image data Da in the X frame is decreasing from the gray scale value u2 of the previous (X−1) frame. Here, since the negative polarity is designated, a relationship of u1<u2 is established. On the account, since the gray scale voltages specified in the image data Da increase over the range from the (X−1) frame to the X frame and a difference between the gray scale voltages is negative, the voltage pattern selecting unit 15 selects the third pattern. Accordingly, the image data Db corresponding to the pixel become a gray scale voltage U5 shifted in a voltage decreasing direction, rather than the gray scale voltage U1 corresponding to the gray scale value u1, in the first field of the X frame and a gray scale voltage U6 shifted in a voltage increasing direction opposite to the voltage decreasing direction, rather than the gray scale voltage U1, in the subsequent second field.

In addition, the gray scale voltages U5 and U6 are gray scale voltages corresponding to adjacent gray scale values of the gray scale value u1, for example, and have a relationship with the gray scale voltage U1 corresponding to the gray scale value u1, that is, a relationship of U5>U1>U6.

The (X+1) frame has the same gray scale value u1 as the X frame, and has the same gray scale voltage as the X frame since both frames have the negative polarity, as described above.

On this account, since the voltage pattern selecting unit 15 selects the first pattern in the (X+1) frame, the image data Db specifies the gray scale voltage U1 corresponding to the gray scale value u1 in the first and second fields.

In this manner, in the fourth embodiment, regardless of whether or not the gray scale values specified in the image data Da of the current frame are gray scale values corresponding to the outputtable voltages of the X driver 30, the second pattern is selected when the gray scale voltages specified in the image data Da of the current frame increase from the previous frame and the third pattern is selected when the gray scale voltages decrease.

In this manner, in the fourth embodiment, when the gray scale values specified in the image data Da in the current frame are varied to become higher than the gray scale voltages of the previous frame, the gray scale voltages shifted in the increasing direction to become higher than the gray scale voltages specified in the image data Da are controlled to be applied to the preceding first field. On the other hand, when the gray scale values specified in the image data Da of the current are varied to become lower than the gray scale voltages of the previous frame, the gray scale voltages shifted in the decreasing direction to become lower than the gray scale voltages specified in the image data Da are controlled to be applied to the preceding first field.

Accordingly, according to the fourth embodiment, display characteristics of the liquid crystal display panel 50 can be improved and a response speed thereof can be increased.

In the fourth embodiment, the case where one frame is divided into two fields is described. However, the present invention is applicable to a case where one frame is divided into three fields or four fields, for example, instead of two fields.

Now, a case where one frame is divided into three fields will be described. Also in this case, the voltage pattern selecting unit 15 of the data processing circuit 10 selects one of the first, second and third patterns based on the amount of variation (difference) of the gray scale voltages specified in the image data Da over the range from the previous frame to the current frame.

However, when one frame is divided into three fields, that is, first, second and third fields, the first, second and third patterns are different from those shown in FIG. 12.

Although not shown particularly, in the first pattern corresponding to no variation of the gray scale voltages, the gray scale voltages specified in the image data Da of the current frame are predetermined over the range from the first field to the third field.

In addition, in the second pattern corresponding to the increase of the gray scale voltages, a gray scale voltage in the first field becomes higher than the gray scale voltages specified in the image data Da of the current frame, a gray scale voltage in the second field becomes lower than the gray scale voltages specified in the image data Da of the current frame, and a gray scale voltage in the third field becomes the gray scale voltage specified in the image data Da of the current frame.

In addition, the second and third patterns have a relationship that an average value of the gray scale voltages of the first and second fields becomes a gray scale voltage of the third field.

Next, in the fourth embodiment, when one frame is divided into three fields, that is, the first, second and third fields, marks obtainable when the gray scale values or mark polarities of the pixels are varied from an immediate previous frame will be considered.

Figure 23A:
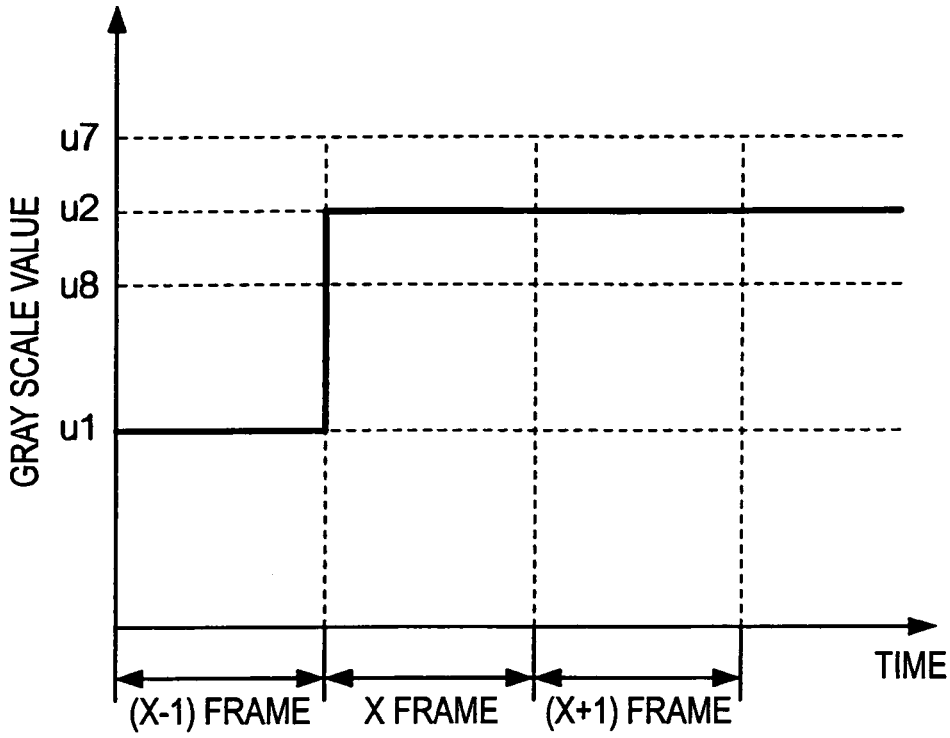
FIG. 23A is a view illustrating variations of a gray scale value a liquid crystal display device according to a fifth embodiment of the present invention.

FIG. 23A is a view illustrating variation of the gray scale values specified in the image data Da of one pixel to be considered. In this drawing, a horizontal axis denotes time and a vertical axis denotes a gray scale value.

As shown in this drawing, the image data Da are input in order of an (X−1) frame, an X frame and an (X+1) frame. More specifically, the gray scale value u1 is specified in the (X−1) frame and the gray scale value u2 is specified in the X frame and the (X+1) frame. That is, the gray scale value is varied from the gray scale value u1 to the gray scale value u2 over a range from the (X−1) frame to the X frame, and the gray scale value u2 is predetermined over a range from the X frame to the (X+1) frame.

In addition, both of the gray scale values u1 and u2 are gray scale values corresponding to the outputtable voltages of the X driver 30. In addition, a negative polarity is designated through the (X−1) frame, the X frame and the (X+1) frame.

Figure 23B:
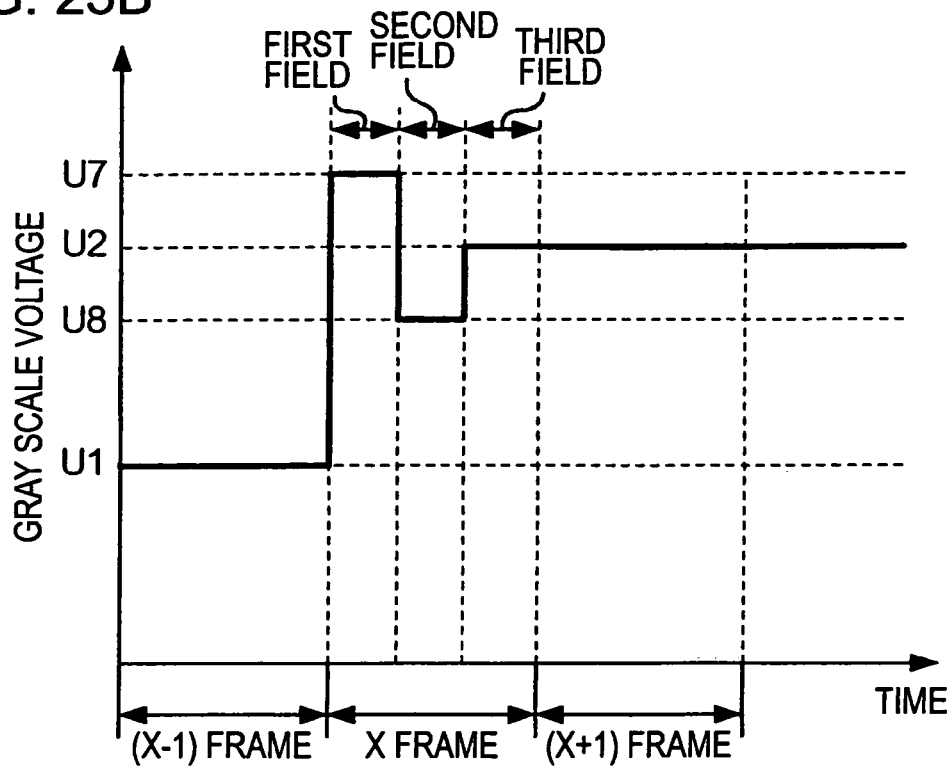
FIG. 23B is a view illustrating variations of a gray scale voltage a liquid crystal display device according to a fifth embodiment of the present invention.

FIG. 23B shows the gray scale voltages specified in the image data Db output from the data processing circuit 10 (the voltage determining unit 18), that is, a voltage applied to the pixel electrode of the pixel to be considered, when the gray scale values specified in the image data Da are varied as shown in FIG. 23A. In this drawing, a horizontal axis denotes time and a vertical axis denotes a gray scale voltage.

When a gray scale value specified in the image data Da in the (X−1) frame is u1, if there is no variation of the gray scale voltages from the previous (X−2) frame (not shown), since the first pattern is selected in the (X−1) frame, a gray scale voltage in the (X−1) frame becomes U1 corresponding to the gray scale value u1 over a range from the first field to the third field.

The gray scale value u2 specified in the image data Da in the X frame is increasing from the gray scale value u1 of the previous (X−1) frame. Here, since the negative polarity is designated, a relationship of u2>u1 is established. On the account, since the gray scale voltages specified in the image data Da increase over the range from the (X−1) frame to the X frame and a difference between the gray scale voltages is positive, the voltage pattern selecting unit 15 selects the second pattern. Accordingly, the image data Db corresponding to the pixel becomes a gray scale voltage U7 shifted in a voltage increasing direction, rather than a gray scale voltage U2 corresponding to the gray scale value u2, in the first field of the X frame, a gray scale voltage U8 shifted in a voltage decreasing direction opposite to the voltage increasing direction, rather than the gray scale voltage U2, in the subsequent second field, and the gray scale voltage U2 corresponding to the gray scale value u2 in the subsequent third field.

In addition, the gray scale voltages U7 and U8 are gray scale voltages corresponding to adjacent gray scale values of the gray scale value u2, for example, and have a relationship with the gray scale voltage U2 corresponding to the gray scale value u2, that is, a relationship of U7>U2>U8.

The (X+1) frame has the same gray scale value u2 as the X frame, and has the same gray scale voltage as the X frame since both frames have the negative polarity, as described.

On this account, since the voltage pattern selecting unit 15 selects the first pattern in the (X+1) frame, the image data Db specifies the gray scale voltage U2 corresponding to the gray scale value u2 in the first, second and third fields.

In addition, when corresponding scan lines in each field of one frame are selected, the image data Db corresponding to the field are converted to an analog signal by the x driver 30 and the analog signal is applied to corresponding signal lines. Accordingly, the gray scale voltages specified in the image data Db are applied to the pixel electrode.

In this manner, according to the fourth embodiment, even when one frame is divided into three fields and four or more fields, display characteristics of the liquid crystal display panel 50 can be improved and a response speed thereof can be increased.

Fifth Embodiment

In the above-described embodiments, for one pixel to be considered, a voltage applied to the pixel electrode of the pixel in each field of the current frame is determined depending on variation of the gray scale voltages specified in the image data Da over the range from the previous frame to the current frame. That is, when two adjacent frames are considered, a voltage applied to each field of a later frame is determined depending on variation of a gray scale voltage from a previous frame.

However, the present invention is not limited to this configuration. For example, it may be configured that, when two adjacent frames are considered, a voltage applied in each field of a previous frame is determined depending on variation of a gray scale voltage to a later frame.

Now, a fifth embodiment employing such configuration will be described. A frame later than the current frame to be processed is called a 'next frame'.

In the fifth embodiment, a voltage pattern of the current frame is selected based on the image data Da of the current frame and the next frame. More specifically, for example, the voltage determining unit 18 of the data processing circuit 10 assumes image data read from the frame memory 11 and delayed by one frame as the image data of the current frame, assumes image data directly supplied from the external super ordinate device as the image data of the next frame, and selects a voltage pattern of the current frame based on the image data of the current frame and the next frame. Accordingly, in the fifth embodiment, a display delayed for the image data supplied from the external super ordinate device is achieved.

The reason for such configuration is to avoid inconsistency in time by assuming the previous frame in the first to fourth embodiments as the current frame in the fifth embodiment and assuming the current frame in the first to fourth embodiments as the next frame in the fifth embodiment because image data of the next frame in future will not be supplied at a stage in which the image data Da of the current frame is supplied.

In addition, when one frame is divided into two fields, that is, the first and second fields, the first pattern is the same as FIG. 14, but the second and third patterns are in a reverse relationship with those shown in FIG. 14. That is, when the variation direction of a gray scale voltage is the increasing direction, the gray scale voltage becomes a voltage shifted in the variation direction in the second field of the current frame and a voltage shifted in a direction opposite to the variation direction in the first field of the current frame, and the voltage of the second field becomes higher than the voltage of the first field. On the contrary, when the variation direction of the gray scale voltage is the decreasing direction, the voltage of the second field becomes lower than the voltage of the first field.

In addition, in the fifth embodiment, one frame is divided into two fields, for example, like the second embodiment, and the voltage pattern selecting unit 15 in the data processing circuit 10 selects the first pattern if the gray scale voltages specified in the image data Da of the current frame are the outputtable voltages of the X driver 30. In addition, if the gray scale voltages specified in the image data Da of the current frame are not the outputtable voltages of the X driver 30, the voltage pattern selecting unit 15 selects the second pattern because of the image data Db of the current frame if the difference between the gray scale voltages over the range from the current frame to the next frame is positive (that is, the variation direction is the increasing direction) and selects the third pattern if the difference is negative (that is, the variation direction is the decreasing direction).

In addition, if the gray scale voltages decoded in the decoder 12 are not the outputtable voltages of the X driver 30, the voltage pattern selecting unit 15 again outputs the voltage pattern selected in the previous frame and also in the current frame when the difference between the gray scale voltages over the range from the current frame to the next frame is 0.

Next, in the fifth embodiment, marks of voltages will be considered.

Figure 24A:
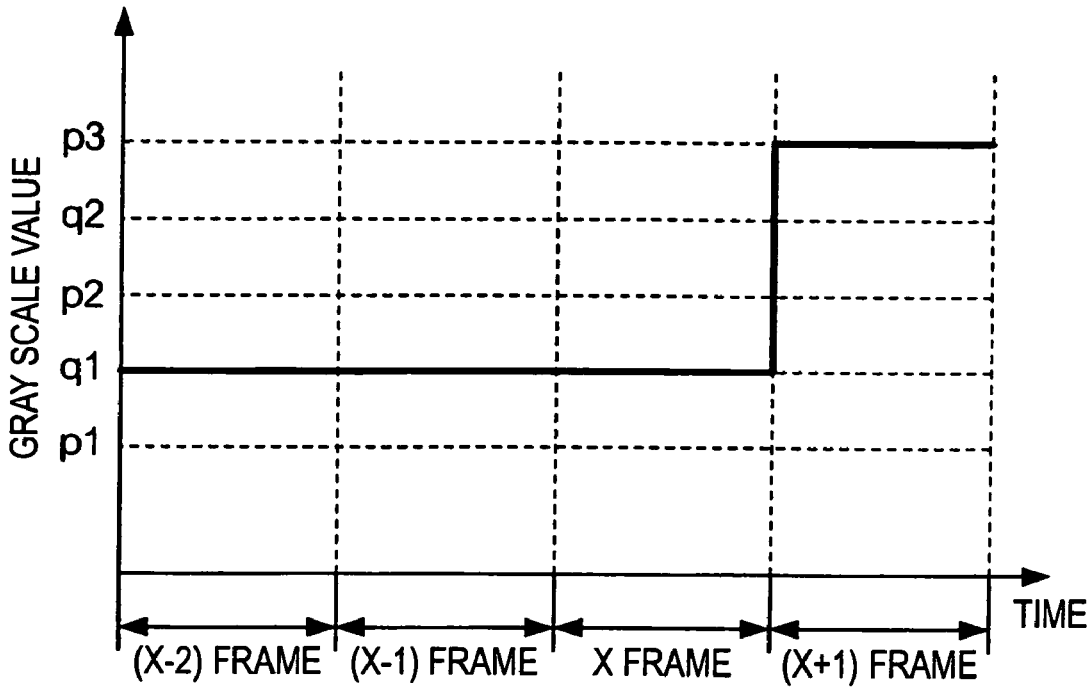
FIG. 24A is a view illustrating variations of a gray scale value in the liquid crystal display device.

FIG. 24A is a view illustrating variation of the gray scale values specified in the image data Da of the pixel to be considered. In this drawing, a horizontal axis denotes time and a vertical axis denotes a gray scale value.

As shown in this drawing, the image data Da is input in order of an (X−2) frame, an (X−1) frame, an X frame and an (X+1) frame. More specifically, a gray scale value q1 is specified in the (X−2) to X frames and a gray scale value p3 is specified in the (X+1) frame. That is, the gray scale value is predetermined with the gray scale value q1 in the (X−2) frame to the X frame, and the gray scale value is varied from the gray scale value q1 to the gray scale value p3 over the range from the X frame to the (X+1) frame.

In addition, the gray scale values q1 is not a gray scale value corresponding to the outputtable voltages of the X driver 30, but the gray scale value p3 is a gray scale value corresponding to the outputtable voltages of the X driver 30. In addition, a negative polarity is designated through the (X−2) frame, the (X−1) frame, the X frame and the (X+1) frame.

Figure 24B:
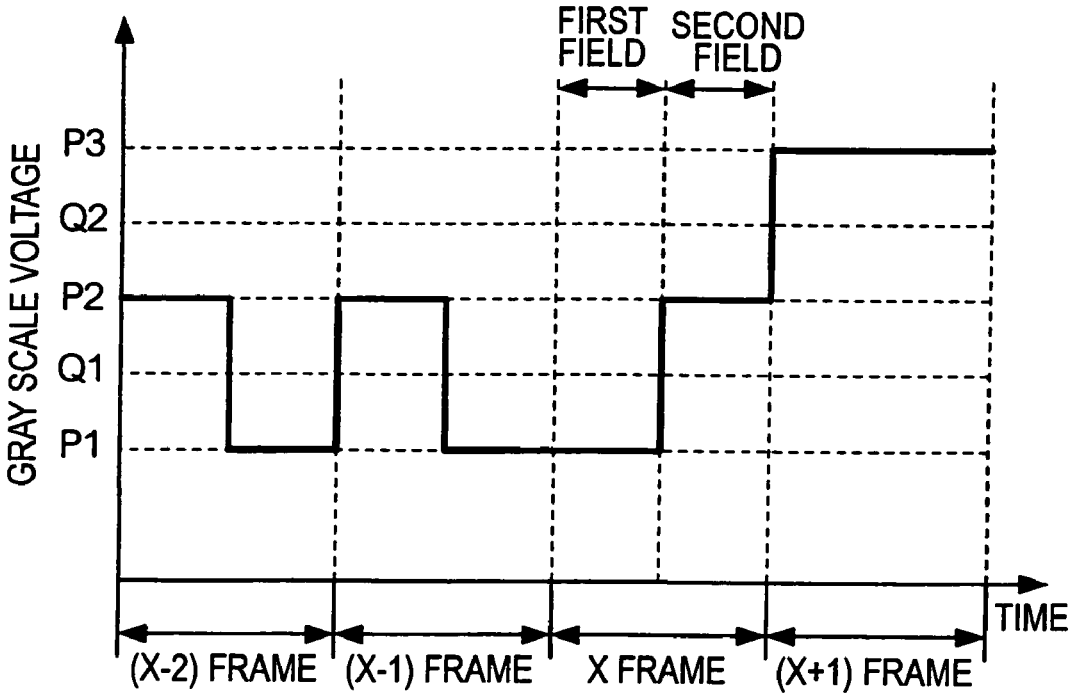
FIG. 24B is a view illustrating variations of a gray scale voltage in the liquid crystal display device.

FIG. 24B shows the gray scale voltages specified in the image data Db output from the data processing circuit 10 (the voltage determining unit 18), that is, a voltage applied to the pixel electrode of the pixel to be considered, when the gray scale values specified in the image data Da are varied as shown in FIG. 24A. In this drawing, a horizontal axis denotes time and a vertical axis denotes a gray scale voltage.

When a pixel is considered, the gray scale value q1 specified in the image data Da in the (X−1) frame is not a gray scale value corresponding to the outputtable voltages of the X driver 30 and there is no variation of the gray scale voltages from the (X−2) frame. On this account, the voltage pattern selecting unit 15 again selects a voltage pattern of the (X−2) frame as a voltage pattern of the (X−1) frame for the pixel. That is, the image data Db corresponding to the pixel specify the gray scale voltage P2 in the first field of the (X−1) frame and the gray scale voltage P1 in the subsequent second field.

Here, the gray scale voltages P2 and P1 are gray scale voltages corresponding to adjacent gray scale values of the gray scale value q1, for example, and have a relationship with a non-outputtable gray scale voltage Q1 of the X driver 30 corresponding to the gray scale value q1, that is, a relationship of P1>Q1>P2.

The gray scale value specified in the image data Da increases from q1 to p3 over the range from the X frame to the (X+1) frame. Here, since the negative polarity is designated, a relationship of q1<p3 is established. Accordingly, since the gray scale voltage specified in the image data Da increases over the range from the X frame to the (X+1) frame and a difference is positive, the voltage pattern selecting unit 15 selects the second pattern as the voltage pattern of the X frame for the pixel. Accordingly, the image data Db corresponding to the pixel in the X frame specifies the gray scale voltage P1 in the first field and the gray scale voltage P2 in the second field, contrary to the (X−1) frame.

If the gray scale value p3 specified in the image data Da in the (X+1) frame is a gray scale value corresponding to the outputtable voltages of the X driver 30 and there is no variation of the gray scale voltage in an (X+2) frame (not shown), the voltage pattern selecting unit 15 selects the first pattern as the voltage pattern of the (X+1) frame for the pixel. Accordingly, the image data Db corresponding to the pixel in the (X+1) frame specify a gray scale voltage P3 corresponding to the gray scale value p3 in the first and second fields.

In addition, when corresponding scan lines in each field of one frame are selected, the image data Db corresponding to the field is converted to an analog signal by the x driver 30 and the analog signal is applied to corresponding signal lines. Accordingly, the gray scale voltages specified in the image data Db are applied to the pixel electrode.

In this example, the case where the gray scale voltages specified in the image data Da increase has been described. Now, the case where the gray scale voltages specified in the image data Da decrease will be considered.

Figure 25A:
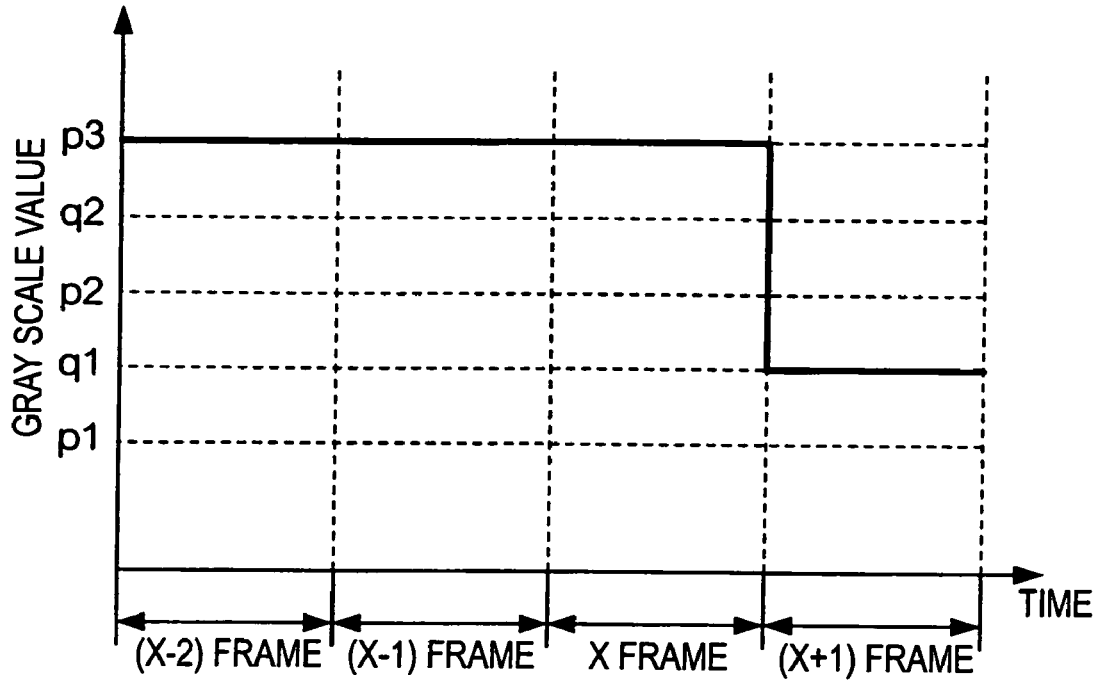
FIG. 25A is a view illustrating variations of a gray scale value in the liquid crystal display device.

FIG. 25A is a view illustrating variation of the gray scale values specified in the image data Da of the pixel to be considered. In this drawing, a horizontal axis denotes time and a vertical axis denotes a gray scale value.

As shown in this drawing, the image data Da is input in order of the (X−2) frame, the (X−1) frame, the X frame and the (X+1) frame. More specifically, the gray scale value p3 is specified in the (X−2) to X frames and the gray scale value q1 is specified in the (X+1) frame. That is, the gray scale value is predetermined with the gray scale value p3 in the (X−2) frame to the X frame, and the gray scale value is varied from the gray scale value p3 to the gray scale value q1 over the range from the x frame to the (X+1) frame.

In addition, the gray scale values p3 is not a gray scale value corresponding to the outputtable voltages of the x driver 30, but the gray scale value q1 is a gray scale value corresponding to the outputtable voltages of the X driver 30. In addition, a negative polarity is designated through the (X−2) frame, the (X−1) frame, the X frame and the (X+1) frame.

Figure 25B:
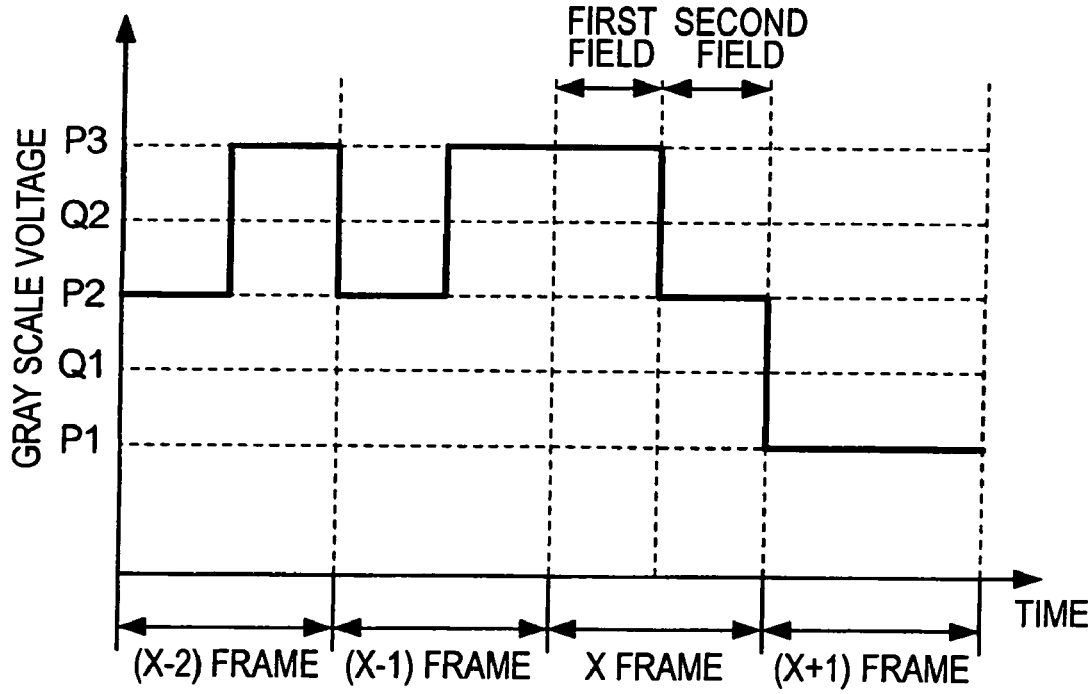
FIG. 25B is a view illustrating variations of a gray scale voltage in the liquid crystal display device.

FIG. 25B shows the gray scale voltages specified in the image data Db output from the data processing circuit 10 (the voltage determining unit 18), that is, a voltage applied to the pixel electrode of the pixel to be considered, when the gray scale values specified in the image data Da are varied as shown in FIG. 25A. In this drawing, a horizontal axis denotes time and a vertical axis denotes a gray scale voltage.

When a pixel is considered, the gray scale value p3 specified in the image data Da in the (X−1) frame is not a gray scale value corresponding to the outputtable voltages of the X driver 30 and there is no variation of the gray scale voltages from the (X−2) frame. On this account, the voltage pattern selecting unit 15 again selects a voltage pattern of the (X−2) frame as a voltage pattern of the (X−1) frame for the pixel. That is, the image data Db corresponding to the pixel specify the gray scale voltage P2 in the first field of the (X−1) frame and the gray scale voltage P3 in the subsequent second field.

Here, the gray scale voltages P2 and P3 are gray scale voltages corresponding to adjacent gray scale values of the gray scale value q2, for example, and have a relationship with a non-outputtable gray scale voltage Q2 of the X driver 30 corresponding to the gray scale value q2, that is, a relationship of P2>Q2>P3.

The gray scale value specified in the image data Da decreases from p3 to q1 over the range from the X frame to the (X+1) frame. Here, since the negative polarity is designated, a relationship of p3<q1 is established. Accordingly, since the gray scale voltage specified in the image data Da decreases over the range from the X frame to the (X+1) frame and a difference is negative, the voltage pattern selecting unit 15 selects the third pattern as the voltage pattern of the X frame for the pixel. Accordingly, the image data Db corresponding to the pixel in the X frame specifies the gray scale voltage P3 in the first field and the gray scale voltage P2 in the second field, contrary to the (X−1) frame.

If the gray scale value q1 specified in the image data Da in the (X+1) frame is a gray scale value corresponding to the outputtable voltages of the X driver 30 and there is no variation of the gray scale voltage in an (X+2) frame (not shown), the voltage pattern selecting unit 15 selects the first pattern as the voltage pattern of the (X+1) frame for the pixel. Accordingly, the image data Db corresponding to the pixel in the (X+1) frame specify a gray scale voltage P1 corresponding to the gray scale value p1 in the first and second fields.

In this manner, in the fifth embodiment, when the gray scale voltages are varied over the range of the current frame to the next frame, since a voltage shifted in a direction opposite to the variation direction is marked on the liquid crystal capacitor in the first field of the current frame and a voltage in the variation direction is marked on the liquid crystal capacitor in the subsequent second field, it is possible to improve the responsiveness of the liquid crystal 305 having a relatively slow response speed, as in the first to fourth embodiment. In addition, in this embodiment, even when gray scale to be represented for one frame corresponds to a non-outputtable voltage of the X driver 30, since the gray scale includes pseudo gray scale values represented in the first and second fields using the gray scale values corresponding to the outputtable voltages of the X driver 30, it is possible to increase the number of representable gray scale levels.

Applications and Modifications

In the above embodiments, in fields into which one frame is divided, the gray scale voltages having a difference at a high level or a low level with respect to the voltage LCcom of the common electrode 308 depending on the gray scale values of a pixel to be considered are applied to the signal lines corresponding to the pixel. However, the present invention is not limited to this. For example, it is sufficient if the liquid crystal capacitor 320 maintains an effective voltage according to gray scale values on a per-field basis. Accordingly, for example, it may be configured that pulse signals having a width according to gray scale values are applied to the signal lines corresponding to the pixel.

Figure 2B:
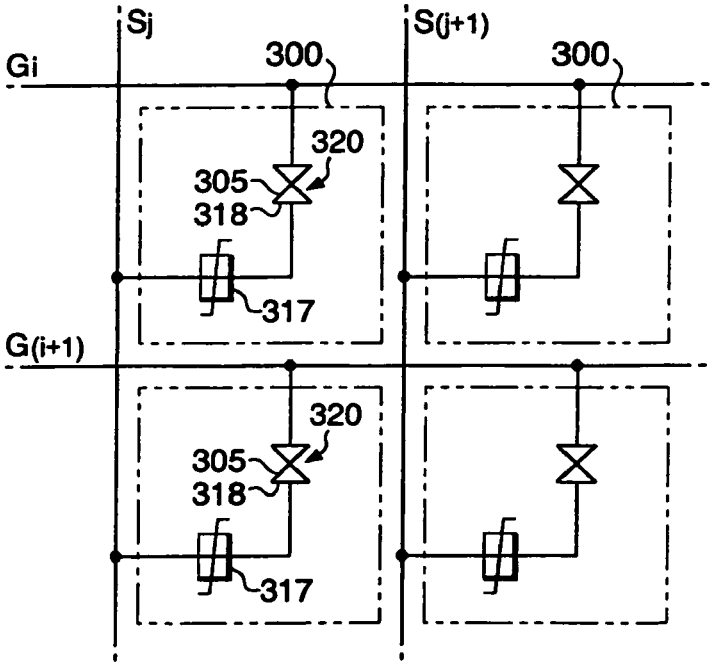
FIG. 2B is a view illustrating configuration of pixels in the liquid crystal display device.

When the pulse signals having the width according to the gray scale values are applied to the signal lines, the pixels 300 will be here described by way of example of the configuration shown in FIG. 2B although they may have the configuration shown in FIG. 2A.

FIG. 2B is a view illustrating configuration of four (2×2) pixels formed at intersections of an i-th row, an adjacent (i+1)-th row, a j-th column, and an adjacent (j+1)-th column.

As shown in this drawing, each of the pixels 300 which are arranged at intersections of scan lines $G_i$ and $G_{(i+1)}$ and signal lines $S_j$ and $S_{(j+1)}$, includes a liquid crystal capacitor 320 and a thin film diode (TFD) 317 connected in series.

Here, for example, a TFD 317 of a pixel 300 at the i-th row and j-th column is turned on when the scan line $G_i$ at the i-th row is applied with a select voltage, regardless of a voltage of a data signal supplied to the signal line $S_j$ at the j-th column, while being turned off when the scan line $G_i$ is applied with a non-select voltage. A liquid crystal capacitor 320 at the i-th row and j-th column has one electrode connected to the signal line $S_j$ at the j-th column and the other electrode 318 connected to the pixel electrode connected to the TFD 317, with the liquid crystal 305 interposed between both electrodes, and has transmittance (or reflectivity) depending on an effective voltage across both electrodes.

Accordingly, even though only signal lines at the j-th and (j+1)-th columns are shown in FIG. 2B, signal lines at each column are formed in a stripe shape such that the signal lines are opposite to the pixel electrodes 318 of the pixels 300 at one column.

Figure 26:
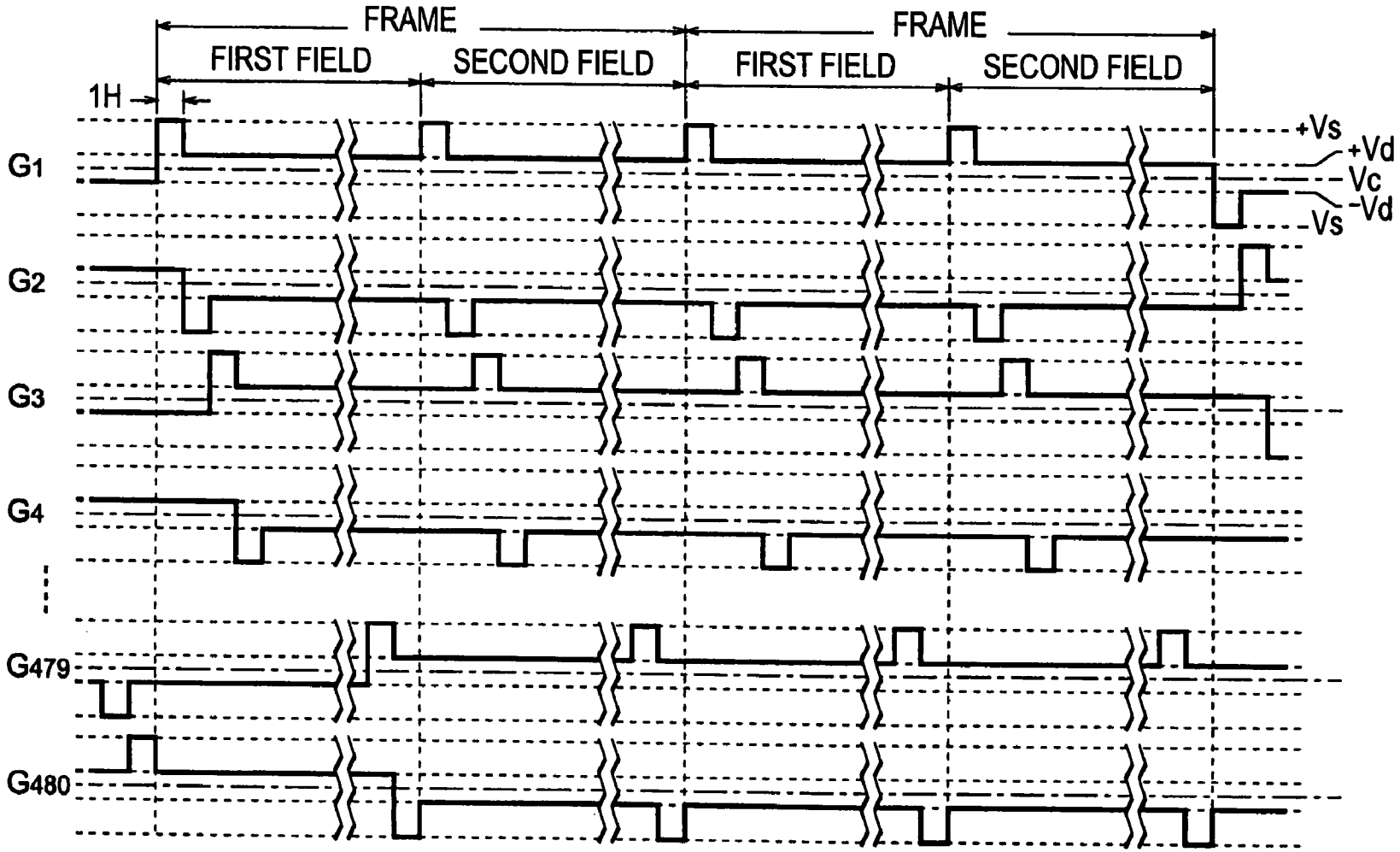
FIG. 26 is a view illustrating an example of voltage waveforms of scan lines in a liquid crystal display device according to an application and modification of the present invention.
Figure 27:
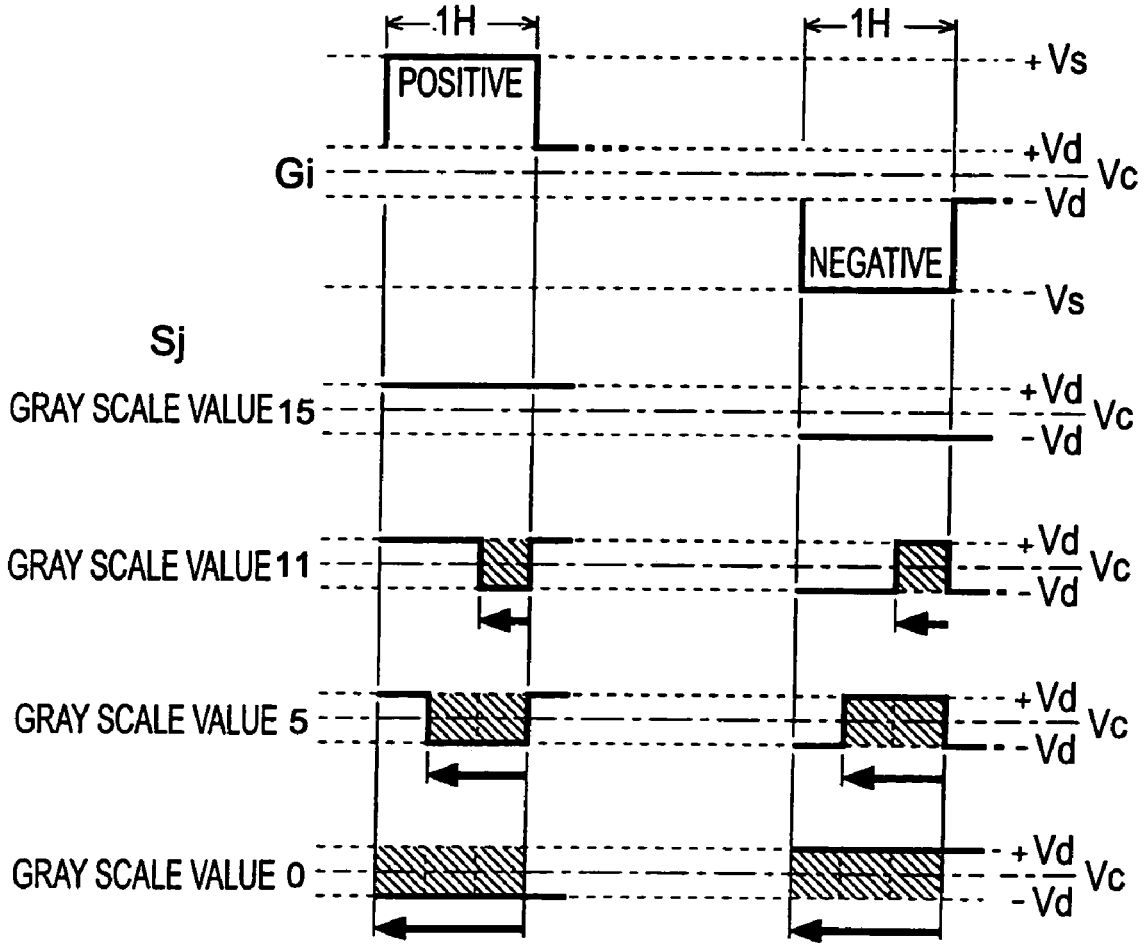
FIG. 27 is a view illustrating an example of voltage waveforms of scan lines in the liquid crystal display device.

Accordingly, for the 480×640 pixels 300, for example, it is configured such that the scan lines are selected sequentially and select voltages +Vs and −Vs are alternately applied to the selected scan lines, as shown in FIG. 26, while pulse signals having a width according to the gray scale values are supplied via the scan lines, as shown in FIG. 27. In this configuration, the TFDs 317 of the pixels 300 at one row, which are located on scan lines having the select voltage +Vs or −Vs, are turned on and a voltage difference between the select voltage and a voltage of the pulse signal applied to the scan lines are maintained in the liquid crystal capacitor 320. Even when a scan signal has a non-select voltage +Vd or −Vd to turn off the TFDs 317, the liquid crystal capacitor 320 maintains a voltage when the TFDs 317 are turned on. Accordingly, when the select voltages are applied to the scan lines, the pixels 300 can be displayed with brightness according to the gray scale values by specifying the width of the pulses supplied to the signal lines according to the gray scale values while specifying polarity of the pulses according to polarity of the select voltages.

As shown in FIG. 27, a pulse signal supplied to the signal lines has one of the voltages +Vd and −Vd.

Considering the pixel 300 at the i-th row and j-th column, when the scan line $G_i$ at the i-th row has a positive select voltage +Vs, a negative voltage −Vd increases the effective voltage maintained in the liquid crystal capacitor 320. Accordingly, for the pixel 300 at the i-th row and j-th column, when a gray scale value for each field of the current frame is determined using image data of the current frame and image data of the previous (or next) frame, a pulse having the voltage −Vd prolonged as the gray scale value corresponding to the field becomes small in an interval during which the positive select voltage +Vs is applied is preferably supplied to the signal line $S_j$ at the j-th column.

On the other hand, when the scan line $G_i$ at the i-th row has a negative select voltage −Vs, a positive voltage +Vd increases the effective voltage maintained in the liquid crystal capacitor 320. Accordingly, for the pixel 300 at the i-th row and j-th column, when a gray scale value for each field of the current frame is determined by using image data of the current frame and image data of the previous (or next) frame, a pulse having the voltage +Vd prolonged as the gray scale value corresponding to the field becomes small in an interval during which the negative select voltage −Vs is applied is preferably supplied to the signal line $S_j$ at the j-th column.

In the first to fifth embodiments, the gray scale voltage applied to the pixel electrode is a voltage shifted to a high or low level with respect to the voltage LCcom of the common electrode 308 depending on the gray scale values and includes information on the mark polarity. Accordingly, the width of the pulse signal can be specified by extracting the gray scale values from this information, and a polarity of the pulse signal is preferably a polarity opposite to a polarity of the select voltage applied to the scan lines.

In addition, a reference of the above-mentioned polarity is a potential Vc located at the center of the voltages +Vs and −Vs (+Vd and −Vd), unlike the above-described first to fifth embodiments. In addition, even though it is shown in FIG. 27 that a voltage component of the pulse increasing the effective voltage maintained in the liquid crystal capacitor 320 is in the later part in an interval during which the select voltages are applied to the scan lines, this voltage component may be in the former part in the interval.

In addition, FIG. 26 shows an example of polarity reversion every two frames for the liquid crystal capacitor 320. In addition, FIG. 27 shows only representative gray scale values (gray scale values corresponding to width of pulses outputtable from the X driver 30).

In addition, the present invention is not limited to the use of three voltage patterns (first, second and third patterns). For example, it may be preferable that the number of voltage patterns according to the number of fields into which one frame is divided is prepared in advance and a voltage pattern is determined depending on variation of gray scale voltages.

Alternatively, it may be configured that only one basic voltage pattern is stored. More specifically, when one voltage pattern is stored, it may be configured that re-adjustment information used to re-adjust voltages is stored in correspondence to variation of voltage gray scale values, the re-adjustment information corresponding to the variation of the voltage gray scale values specified by the image data of the previous and current (next) frames is read, and gray scale voltages specified in fields for the voltage patterns are altered based on the read re-adjustment information.

Further, the present invention is not limited to the liquid crystal display device, and is applicable to various kinds of electro-optical devices such as electronic paper.

The entire disclosure of Japanese Patent Application Nos: 2005-083382, filed Mar. 23, 2005 and 2005-273405, filed Sep. 21, 2005 are expressly incorporated by reference herein.

What is claimed is:

1. An electro-optical device which drives a plurality of pixels to represent gray scale levels based on effective voltages by dividing a given frame into a plurality of fields, comprising:

a drive circuit that judges a voltage to be applied to the pixels based on image data that specifies a gray scale value of the given frame for each pixel and outputs the voltage, the drive circuit comprising:

a judgment unit that judges whether a voltage of the given frame corresponding to a gray scale value specified by the image data is a voltage which can be output by the drive circuit;

a voltage pattern determining unit that:

if the judgment unit judges that the voltage can be output by the drive circuit, with respect to the pixels, determines such that a voltage corresponding to a gray scale value specified by the image data is supplied to each of the plurality of fields, and if the judgment unit judges that the voltage cannot be output by the drive circuit, with respect to the pixels, determines so as to supply, in a temporally earlier field of the plurality of fields, a first voltage being shifted in a direction opposite to a variation direction from a voltage according to a gray scale value specified in the image data of a later frame of temporally adjacent frames, and that determines so as to supply, in a temporally later field among the plurality of fields, a second voltage being shifted in the variation direction from the voltage according to the gray scale value specified in the image data of the later frame, wherein the second voltage has a value either equal to the gray scale voltage supplied in the temporally later frame or between the first voltage and the gray scale voltage supplied in the temporally later frame; and a voltage output unit that supplies to each pixel the voltage determined by the voltage pattern determination unit within each field of the given frame, the first voltage applied to a first field of the given frame and the second voltage applied to a second field of the given frame being determined based on the variation direction of the gray scale value from the given frame to the later frame of the temporally adjacent frames, and the first and second voltages being applied based on a polarity of a difference between a voltage over a range of the given frame and a voltage over a range of the later frame.

* * * * *